US009717393B2

(12) United States Patent
Delgado et al.

(10) Patent No.: US 9,717,393 B2
(45) Date of Patent: Aug. 1, 2017

(54) HOUSEHOLD APPLIANCE WITH BULK UNIT-DOSE DISPENSER

(71) Applicant: Whirlpool Corporation, Benton Harbor, MI (US)

(72) Inventors: Kristopher L. Delgado, Stevensville, MI (US); Michael I Hirsh, Stevensville, MI (US); Nathan W. Kryglowski, Stevensville, MI (US); Rafael G. Reyes, Saint Joseph, MI (US); Michael S. Seeley, South Haven, MI (US); Barry E. Tuller, Stevensville, MI (US); Chad T. Vanderroest, Covert, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 140 days.

(21) Appl. No.: 14/736,579

(22) Filed: Jun. 11, 2015

(65) Prior Publication Data

US 2015/0359412 A1 Dec. 17, 2015

Related U.S. Application Data

(60) Provisional application No. 62/011,257, filed on Jun. 12, 2014.

(51) Int. Cl.

| | |
|---|---|
| *A47L 15/42* | (2006.01) |
| *A47L 15/48* | (2006.01) |
| *A47L 15/44* | (2006.01) |

(52) U.S. Cl.
CPC ..... *A47L 15/4463* (2013.01); *A47L 15/4257* (2013.01); *A47L 15/486* (2013.01); *A47L 15/488* (2013.01)

(58) Field of Classification Search
CPC ..... B08B 3/02; A47L 15/486; A47L 15/488; A47L 15/4257; A47L 15/4463; A47K 5/00; G01F 11/00; D06F 39/02; D06F 39/026; D06F 39/028; D65D 5/72
See application file for complete search history.

(56) References Cited

U.S. PATENT DOCUMENTS

| | | | | |
|---|---|---|---|---|
| 7,594,513 | B2 | 9/2009 | Vanderroest et al. | |
| 8,146,610 | B2 * | 4/2012 | Gibis | A47L 15/4463 134/93 |
| 2005/0241347 | A1 * | 11/2005 | Cho | D06F 39/028 68/243 |
| 2010/0000586 | A1 * | 1/2010 | Hendrickson | D06F 39/00 134/56 D |
| 2014/0137911 | A1 * | 5/2014 | Baldwin | A47L 15/44 134/200 |

* cited by examiner

*Primary Examiner* — Michael Barr
*Assistant Examiner* — Rita Adhlakha
(74) *Attorney, Agent, or Firm* — McGarry Bair PC

(57) ABSTRACT

A household appliance, such as dishwasher, includes a bulk unit-dose dispenser configured to hold multiple unit doses of treating chemistry and dispense the treating chemistry at the appropriate time in a cycle of operation. The bulk unit-dose dispenser can include a multiple compartments moveable along a track, and the compartments can be sequentially moved into registry with a dispensing opening of the appliance.

38 Claims, 25 Drawing Sheets

HOUSEHOLD APPLIANCE WITH BULK UNIT-DOSE DISPENSER

CROSS REFERENCE TO RELATED APPLICATION(S)

This application claims the benefit of U.S. Provisional Patent Application No. 62/011,257, filed Jun. 12, 2014, which is incorporated herein by reference in its entirety.

BACKGROUND OF THE INVENTION

Many contemporary dishwashers for use in a typical household include a wash tub for storing utensils during a wash cycle in which the stored utensils are cleaned. A dispensing system may be provided for dispensing a treating chemistry as part of the cycle of operation. Generally, dishwasher dispensers are single dosage and must be loaded prior to each cycle. Current trends in dishwasher detergents have moved away from gels and powders to unit dose tablets and pods. It would be beneficial to provide a bulk dispenser for dishwasher detergent tablets and pods to reduce the frequency a user needs to refill the dispenser. Other household appliances may also benefit from such a bulk dispenser.

BRIEF SUMMARY

According to one aspect of the invention, a household appliance includes a treating chamber, a liquid sprayer emitting liquid into the treating chamber, and a bulk unit-dose dispenser, which includes a housing having a dispensing opening that is open to the treating chamber, a track within the housing, and a plurality of compartments moving along the track, with the compartments configured to each receive an individual unit-dose of a treating chemistry, wherein the compartments can be moved along the track into sequential registry with the dispensing opening, and the emitted liquid from the liquid sprayer rinses a unit-dose of treating chemistry from the compartment into the treating chamber through the dispensing opening.

According to another aspect of the invention, a household appliance includes a treating chamber defined by at least one wall having a dispensing opening, a liquid sprayer emitting liquid into the treating chamber, and a bulk unit-dose dispenser comprising a track and a plurality of compartments moving along the track, with the compartments configured to each receive an individual unit-dose of a treating chemistry, wherein the compartments can be moved along the track into sequential registry with the dispensing opening, and the emitted liquid from the liquid sprayer rinses a unit-dose of treating chemistry from the compartment into the treating chamber.

According to another aspect of the invention, a method of operating a household appliance having a treating chamber, a door assembly selectively closing the treating chamber, a liquid sprayer emitting liquid into the treating chamber, and a bulk unit-dose dispenser having a configured to storage a plurality of unit-doses of treating chemistry includes advancing a unit-dose compartment of the dispenser into registry with a dispensing opening in the door assembly, sealing the compartment with the dispensing opening, and spraying liquid into the dispensing opening to rinse out a unit-dose of treating chemistry within the compartment.

DESCRIPTION OF EMBODIMENTS OF THE INVENTION

Figure 1:
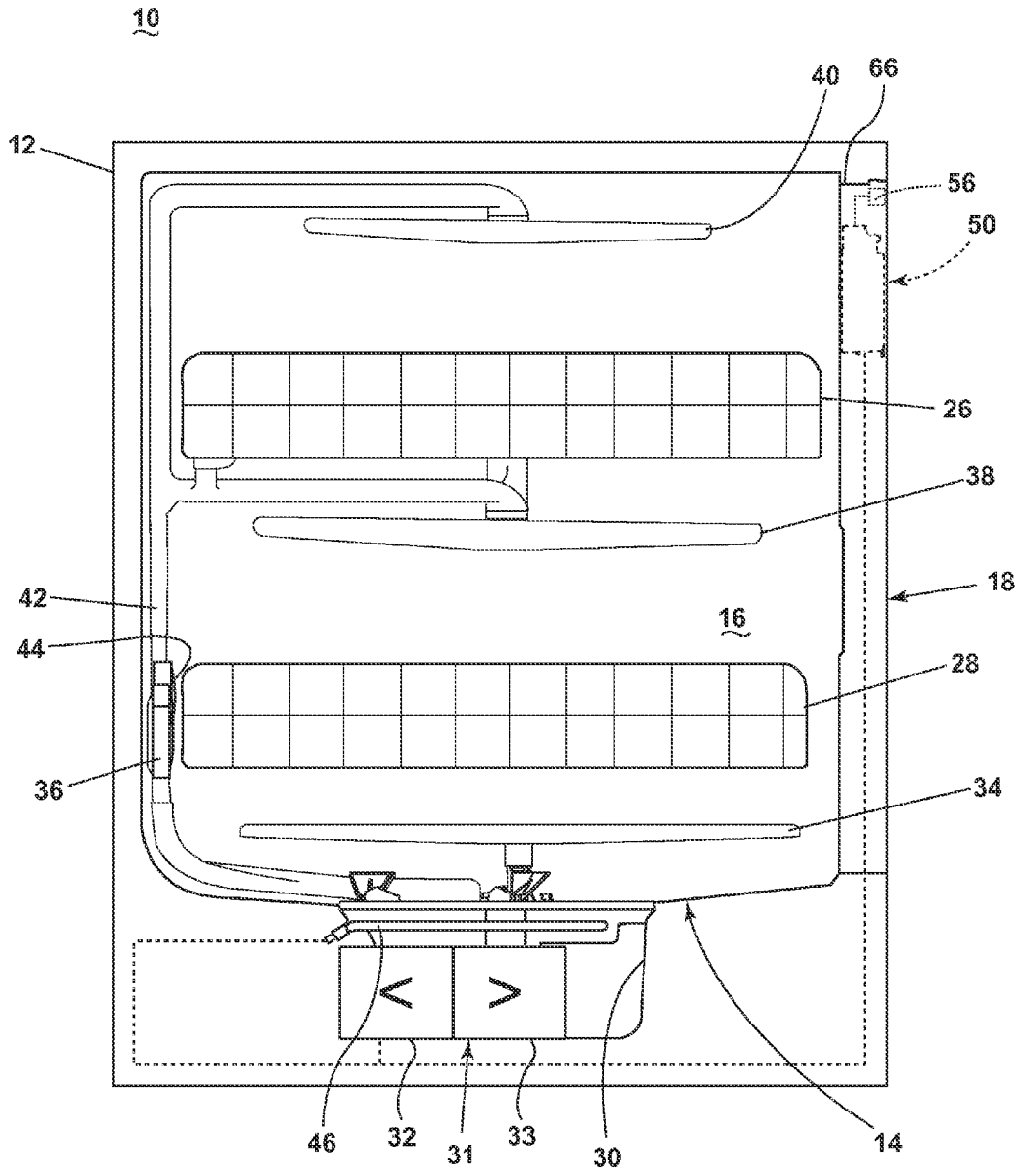
FIG. 1 is a schematic, cross-sectional view of a dishwasher according to a first embodiment of the invention.

In FIG. 1, an automated dishwasher 10 according to a first embodiment is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
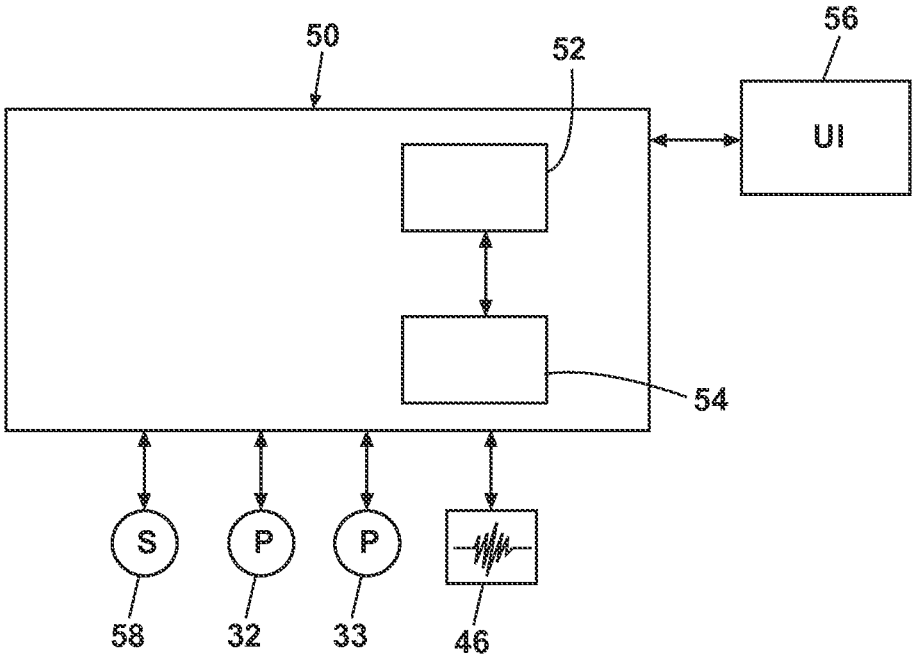
FIG. 2 is a schematic view of a controller of the dishwasher of FIG. 1.

As illustrated schematically in FIG. 2, the controller 50 may be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

The dishwasher 10 may be provided with a bulk dispenser designed to dispense unit dose tablets or pods. In the following description, the terms tablets and pods may be used interchangeably. A unit dose of treating chemistry is an amount of treating chemistry used in a single cycle of operation of the dishwasher. Accordingly, a tablet or pod contains a unit dose of treating chemistry, such as a detergent, rinse aid, or combinations thereof. A unit dose tablet or pod can include more than one treating chemistry, with the entire unit dose tablet or pod intended to be used during one cycle of the dishwasher to clean one load of dishes. The tablets or pods discussed herein may include those comprising a unit dose of solid, powder, liquid, or gel treating chemistries within a pack.

Figure 3A:
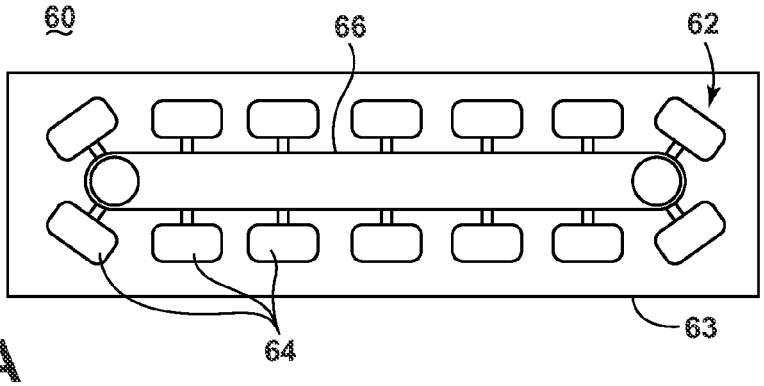
FIGS. 3A-3D are schematic views of a bulk unit-dose track dispenser according to a first embodiment of the invention.
Figure 3B:
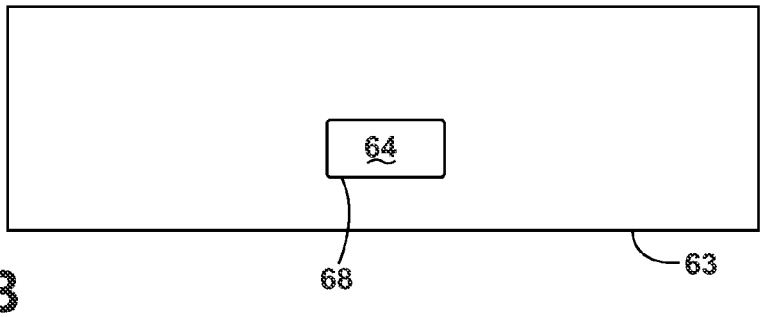
Figure 3C:
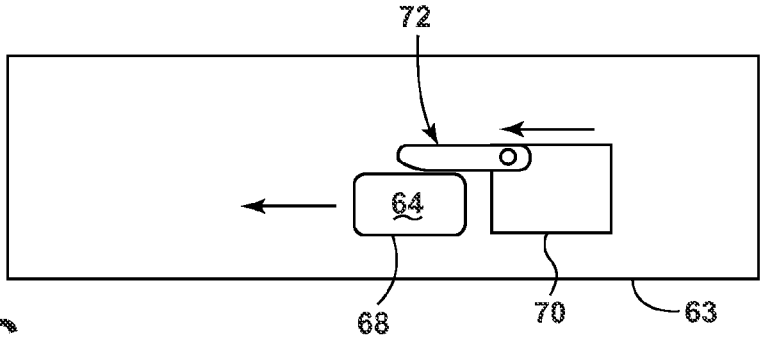

In a first embodiment as shown in FIG. 3A-3D, a unit-dose tablet bulk dispenser 60 with a track mechanism 62 is illustrated. The bulk dispenser 60 includes a housing 63. In this embodiment, multiple compartments 64 are arranged on a track 66. Preferably, the track 66 includes 16-20 compartments 64, although it may include less than 16 or more than 20 compartments 64. Preferably, the compartments 64 are sized to fit most commercially available detergent tablets and pods. The track 66 is driven and advances the compartments 64 to a single dispenser opening 68, shown in FIG. 3B. The track 66 can have a continuous path, and can be circular or elongated as shown. The dispenser opening 68 may be covered by a lid 70 when tablets are not being loaded or dispensed, as shown in FIG. 3C. The lid 70 may be slidably or rotatably connected to the housing 63.

Tablets may also be loaded through the dispenser opening 68. Tablets may be loaded individually. In use, opening the lid 70 engages an advancing mechanism 72 so that sliding the lid 70 to the side pushes the filled compartment 64 forward and reveals another compartment 64. In this manner, a user can fill all or some of the compartments 64. The advancing mechanism 72 shown includes a slide button. For embodiments of the dispenser 60 without a lid 70, such as that shown in FIG. 3B, a lid-independent advancing mechanism can be provided to sequentially advance the compartments 64.

Figure 3D:
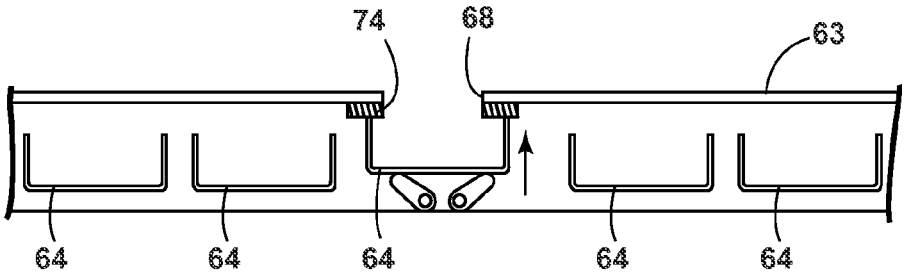

The dispenser 60 is sealed to prevent humidity and moisture from reaching the compartments 64 when not actively dispensing a tablet. Only the compartment 64 ready to dispense is in fluid communication with the treating chamber 16. As shown in FIG. 3C, the active compartment 64 is pressed against the lid 70 of the dispenser 60 in order to form a seal around the top perimeter of the compartment 64. Sealing is accomplished by pushing/raising the compartment 64 to engage a seal 74 on the lid 70 or the housing 63, as shown in FIG. 3D. During a dishwasher cycle, the compartment 64 used in that cycle is sealed to the lid 70 or the housing 63. A spray from the dishwasher wash system can be directed at the single dispenser opening 68 to rinse the compartment 64. The term "rinse" as used herein with respect to the unit-dose bulk dispenser of this and other embodiments includes washing out or flushing the compartment 64 with wash liquid to ensure that the tablet is moved into the treating chamber of the dishwasher.

At the conclusion of a cycle, or just before the start of a new cycle, the dispensing compartment 64 is lowered to break the seal, and the track 66 is advanced to the next compartment 64 containing a detergent tablet. The dispenser drive mechanism for advancing the track 66 and sealing the dispensing compartment 64 can be operated by a single actuator or by multiple actuators. The actuator can be a wax motor or solenoid.

The dispenser 60 can be located in the door assembly 18, at a top of the treating chamber 16, or on a side of the treating chamber 16. The bulk dispenser assembly 60 can be removably mounted in the door assembly 18 or treating chamber 16 such that a user can remove the bulk dispenser 60 for easy loading on a countertop. The dispenser assembly 60 can then be returned to the door assembly 18 or treating chamber 16 and snapped/latched into place, which re-engages the dispenser drive mechanism.

Figure 4:
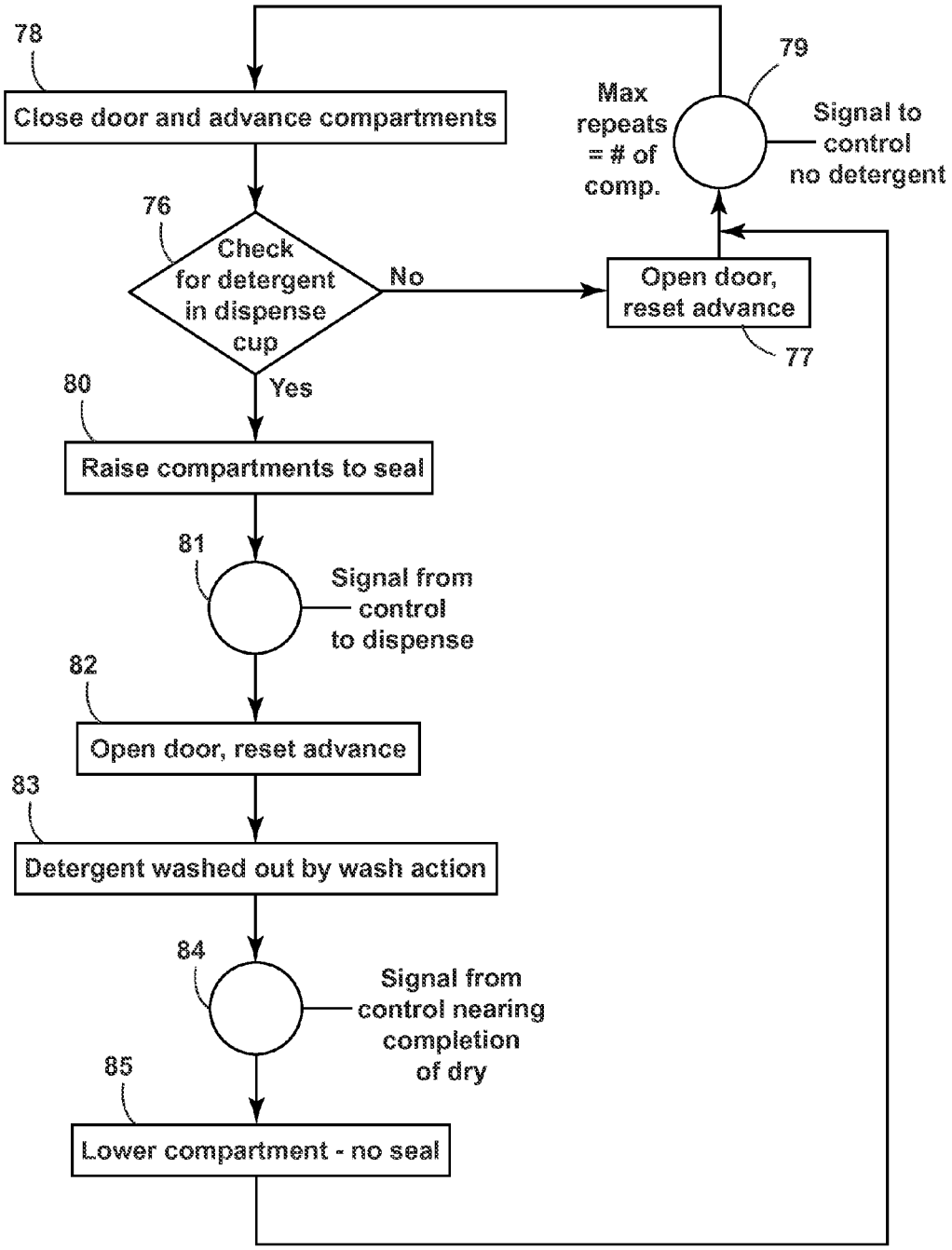
FIG. 4 is a flow chart illustrating the operation of the bulk unit-dose track dispenser of FIGS. 3A-3D.

The operation of the bulk dispenser 60 is illustrated in FIG. 4. The first step 76 includes checking for detergent in the dispenser compartment or cup. If detergent is not present, the lid 70 is opened, which resets the advancing mechanism 72, at step 77. A tablet is loaded into the compartment and the lid is closed at step 78. As the lid 70 is closed, the track 66 is advanced by the drive mechanism to the next compartment 64, which is also checked for detergent, per step. This process can be repeated multiple times until all compartments 64 are filled, however it is not required that all compartments be filled to run a cycle. During this process, a signal can also be sent to the controller if no detergent is present, at step 79, which can be used to notify that user that detergent needs to be loaded, or can be used to sequentially advance through the compartments until one already loaded with a tablet is found.

If detergent is present, the compartment is raised to seal it against the lid 70 or the housing 63 at step 80. When a signal is sent from the controller 50 to dispense the treating chemistry at step 81, the lid 70 is opened, which resets the advancing mechanism 72 at step 82. A spray from the dishwasher wash system is directed at the dispenser opening 68 and the treating chemistry is washed out of the compartment 64 by the wash action at step 83. At the conclusion of a cycle, or just before the start of a new cycle, such as during drying, a signal is sent from the controller 50 to the dispenser 60 at step 84, and the dispensing compartment 64 is lowered to break the seal at step 85. Returning to step 78, the lid 70 is closed, and the track 66 is advanced to the next compartment 64 containing a detergent tablet.

Figure 5:
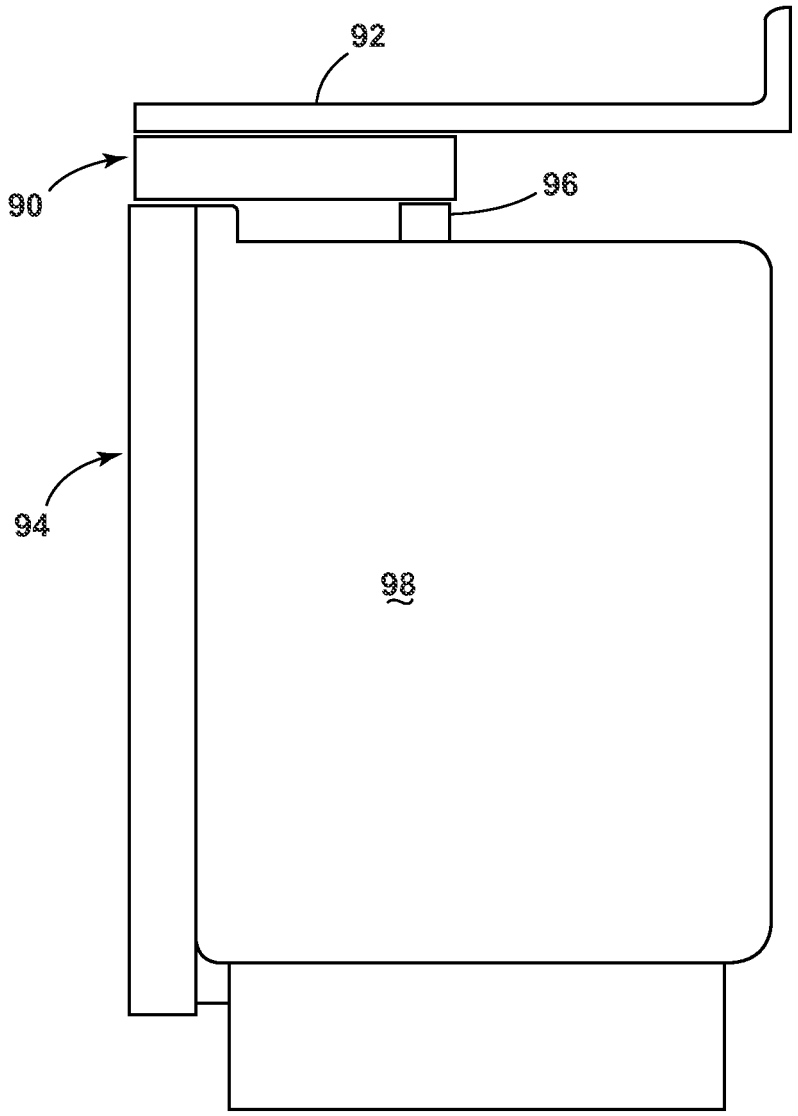
FIG. 5 is a side, schematic sketch of a bulk dispenser drawer mounted to a countertop above a dishwasher according to another embodiment of the invention.

In FIG. 5, a bulk unit-dose dispenser drawer 90 is mounted to a counter-top 92 above a dishwasher 94. The dishwasher 94 includes a dock 96 for placement of the dispenser. In this location, with the dispenser drawer 90 located outside the dishwasher 94 itself, the treating chemistry stored by the dispenser drawer 90 is remote from the heat and humidity of a treating chamber 98 of the dishwasher 94, which helps preserve the integrity of the treating chemistry while it is stored. In one non-limiting example, the height to the counter-top 92 can be approximately 34.5 inches, while the height to the top of the dishwasher 94 can be approximately 33.5 inches, leaving approximately 1.0 inch for accommodating the dispenser drawer 90 underneath the counter-top 92.

It is noted that any dispenser embodiment disclosed herein, including non-drawer dispensers, can be accommodated in this location, with the dispenser, particularly the storage portion of the dispenser which holds the bulk supply of treating chemistry, mounted to the counter-top 92 above the dishwasher 94.

Figure 6A:
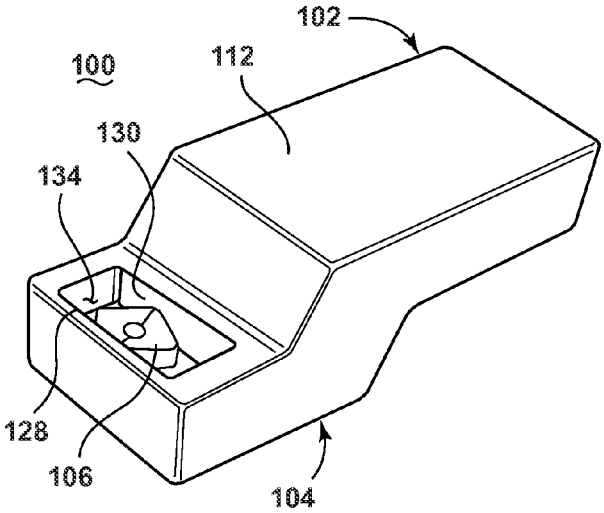
FIG. 6A is a perspective view of a bulk unit-dose dispenser according to another embodiment of the invention.
Figure 6B:
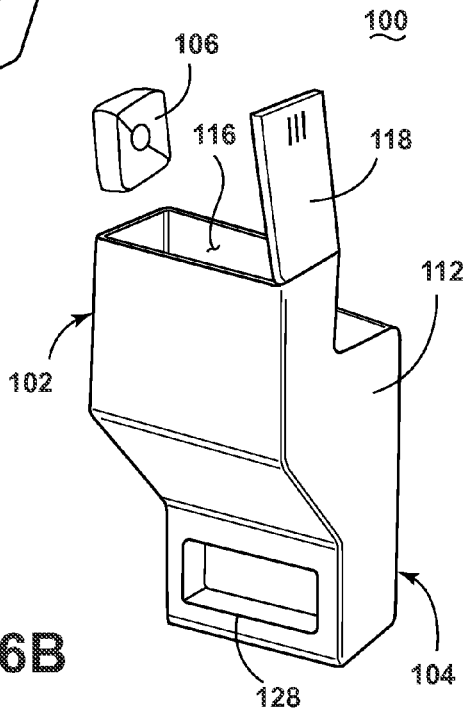
FIG. 6B is a perspective view of the bulk unit-dose dispenser from FIG. 6A being loaded.
Figure 6C:
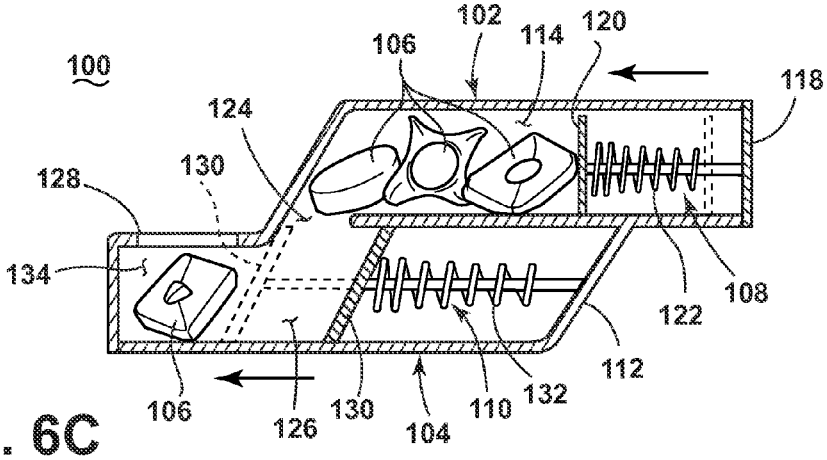
FIG. 6C is a sectional view of the bulk unit-dose dispenser from FIG. 6A.

FIGS. 6A-6C illustrates a bulk unit-dose dispenser 100 that includes two levels 102, 104. Unit-dose tablets 106 are stored on one level 102, and are moved forward either at the completion of a cycle or before a cycle by a first actuator 108. A single tablet 106 drops down to a second level 104 where a second actuator 110 pushes it forward for dispensing. The actuator 110 creates a seal with the dispenser to keep moisture away from the tablets 106 waiting to be dispensed.

The dispenser 100 includes a housing 112 defining the two levels 102, 104. The first level 102 includes an elongated storage chamber 114 which receives multiple unit-dose tablets 106. The tablets 106 can be of identical type, size and composition, or can be dissimilar from each other, including tablets, pods or gel-packs of detergent, rinse aid, or combinations thereof. The tablets 106 can be loaded sequentially into the storage chamber 114 through a loading opening 116 closed by a cover 118. The first actuator 108 can move relative to the closed cover 118 to move the tablets 106 forward either at the completion of a cycle or before a cycle. The first actuator 108 can include a plunger or pusher 120 biased by a spring 122 and can be controlled by a wax motor or solenoid (not shown). The end of the storage chamber 114 opposite the first actuator 108 can include a transfer opening 124 leading to the second level 104.

The second level 104 includes a dispensing chamber 126 which receives one unit-dose tablet 106 and which has a dispensing opening 128. The second actuator 110 can include a plunger or pusher 130 biased by a spring 132 and can be controlled by a wax motor or solenoid (not shown). The second actuator 110 can move between a retracted position in which the pusher 130 is withdrawn beyond the transfer opening 124 to allow one of the tablets 106 to be transferred from the storage chamber 114 to the dispensing chamber 126, and an extended position in which the pusher 130 is moved forward to push the tablet 106 in the dispensing chamber 126 into alignment with the dispensing opening 128.

The pusher 130 can create a seal between the dispensing chamber 126 and the storage chamber 114 in the extended position to keep moisture away from the tablets 106 waiting to be dispensed and to define a sealed dispensing compartment 134. During a cycle of operation, the second actuator 110 can remain in the extended position to maintain the seal throughout the cycle. Upon completion of a cycle or before a new cycle begins, the second actuator 110 can move to the retracted position.

The housing 112 can be provided on the door assembly 18 of the dishwasher 10 as shown in FIG. 1, or under a counter-top above a dishwasher as shown in FIG. 5. For the illustrated dispenser 100, the housing 112 is provided with a dishwasher door, such that the dispensing opening 128 is open to the treating chamber of the dishwasher. With the door in an open position, the first level 102 can be vertically above the second level 104 such that a tablet 106 moved over the transfer opening 124 can fall into the second level 104 by gravity. Closing the door can allow the tablet 106 to fall by gravity into the treating chamber of the dishwasher through the dispensing opening 128. In another configuration, the tablet 106 can remain in the compartment 134 when the door is closed, and liquid emitted by a liquid sprayer of the dishwasher rinses the tablet 106 from the sealed dispensing compartment 134 into the treating chamber through the dispensing opening 128. The housing 112 can be removable from the door for loading tablets 106 into the storage chamber 114 through the loading opening 116.

Figure 7A:
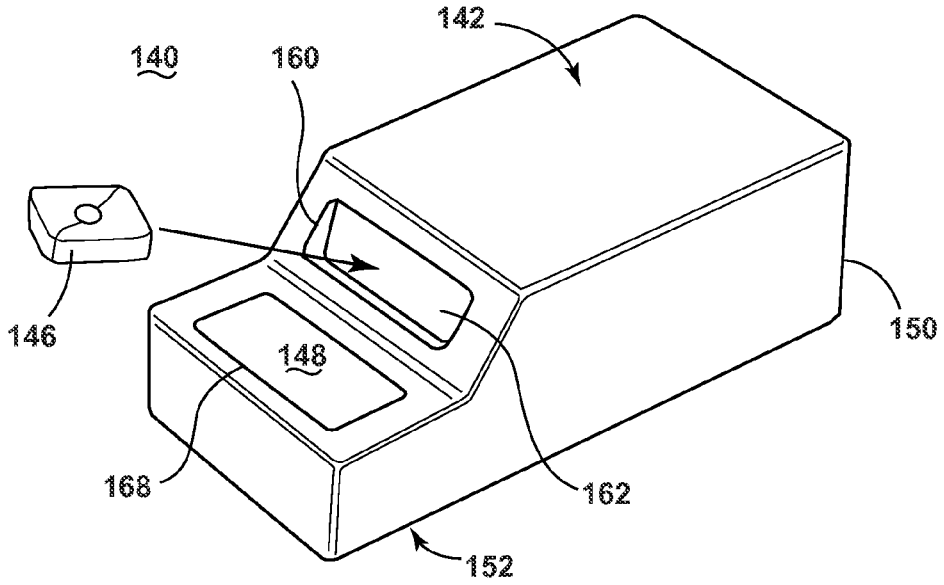
FIG. 7A is a perspective view of a bulk unit-dose dispenser according to another embodiment of the invention.
Figure 7B:
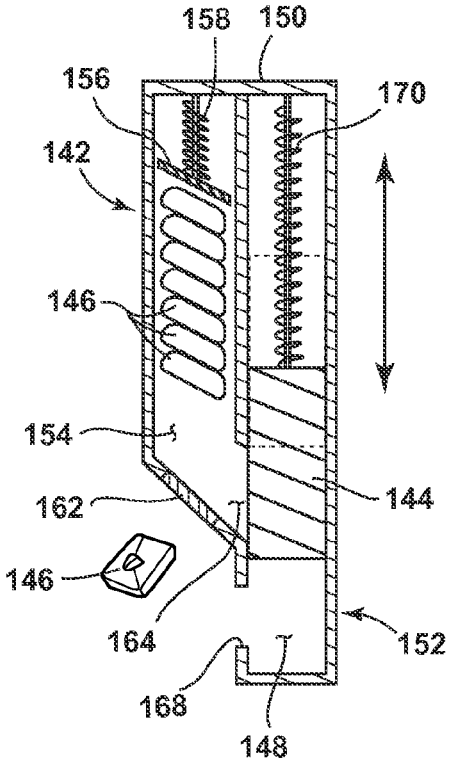
FIG. 7B is a sectional view of the bulk unit-dose dispenser from FIG. 7A.

FIGS. 7A-7B shows a bulk unit-dose dispenser 140 in which the top portion 142 is constantly under spring tension. When a lower plunger 144 momentarily moves back, as shown in dotted line, one tablet 146 falls and is then pushed into a launch chamber 148 or wash zone portion of the device.

The dispenser 140 includes a housing 150 defining two levels, the top portion 142 and a bottom portion 152, with respect to the orientation shown in FIG. 7A. The top portion 142 includes an elongated storage chamber 154 which receives multiple unit-dose tablets 146 that are constantly under spring tension by a plunger 156 that is biased by a spring 158. The tablets 146 can be of identical type, size and composition, or can be dissimilar from each other, including tablets, pods or gel-packs of detergent, rinse aid, or combinations thereof.

The tablets 146 can be loaded sequentially into the storage chamber 154 through a loading opening 160 closed by a cover 162. The cover 162 can be a pivoting flap or door, and is shown pivoted slightly open in FIG. 7A and is shown closed in FIG. 7B. The loading opening 160 is provided opposite the plunger 156 and tablets 146 can be loaded one at a time into the storage chamber 154 by pushing tablets 146 through the loading opening 160. The end of the storage chamber 154 opposite the plunger 156 can include a transfer opening 164 leading to the bottom portion 152.

The bottom portion 152 includes the launch chamber 148, which receives one unit-dose tablet 146 and which has a dispensing opening 168. The plunger 144 can be biased by a spring 170 and can controlled by a wax motor or solenoid (not shown). The plunger 144 can move between a retracted position in which the plunger 144 is withdrawn beyond the transfer opening 164 to allow one of the tablets 146 to be transferred from the storage chamber 154 to the launch chamber 148, and an extended position in which the plunger 144 is moved forward to push the tablet 146 into alignment with the dispensing opening 168. In the extended position, the plunger 144 also blocks the transfer opening 164, and prevents a second tablet from entering the launch chamber 148. The plunger 144 can also create a seal to keep moisture away from the tablets 146 waiting to be dispensed. During a cycle of operation, the plunger 144 can remain in the extended position throughout the cycle. Upon completion of a cycle or before a new cycle begins, the plunger 144 can move to the retracted position to load a new tablet 146 into the launch chamber 148.

The housing 150 can be provided on the door assembly 18 of the dishwasher 10 as shown in FIG. 1, or under a counter-top above a dishwasher as shown in FIG. 5. For the illustrated dispenser 140, the housing 150 is provided with a dishwasher door, such that the dispensing opening 168 is open to the treating chamber of the dishwasher. With the door in an open position, the top portion 142 can be vertically above the bottom portion 152. With the door closed, a tablet 146 can slide along the interior of the cover 162 and into the launch chamber 148 when the plunger 144 moves back. The tablet 146 can continue to fall by gravity into the treating chamber of the dishwasher through the dispensing opening 168, or in another configuration, the tablet 146 can remain in the launch chamber 148, and liquid emitted by a liquid sprayer of the dishwasher rinses the tablet 146 from the launch chamber 148. The housing 150 can be removable from the door for loading tablets 146 into the storage chamber 154 through the loading opening 160, or can remain on the door using loading.

Figure 8:
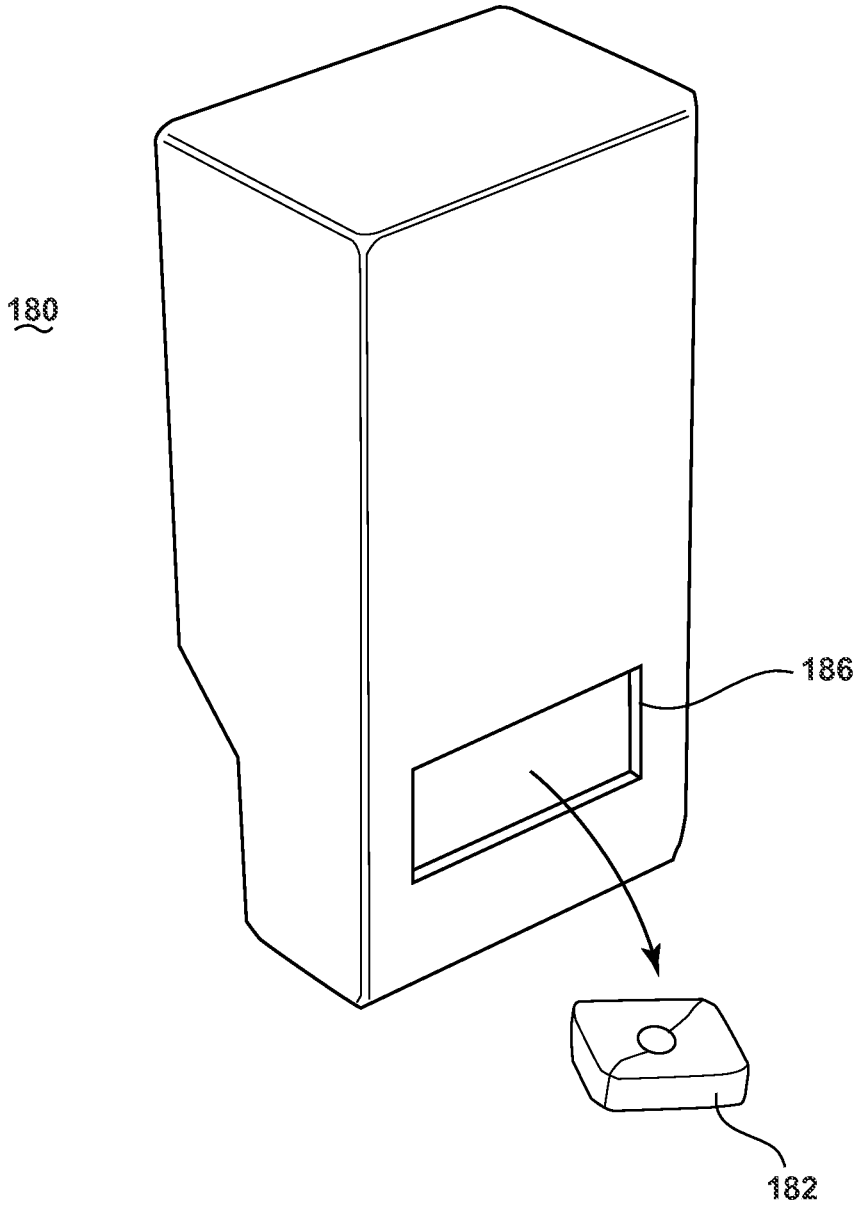
FIG. 8 is a perspective view of a bulk unit-dose dispenser according to another embodiment of the invention.

FIG. 8 illustrates a bulk unit-dose dispenser 180 configured to receive tablets 182 on one side and dispense out the opposite side. An actuator pushes the tablets 182 toward the outlet 186 such that a single tablet 182 is dispensed either at the completion of a cycle or before a cycle. The dispenser 180 can be substantially identical to the dispenser 140 shown in FIGS. 7A-7B, including having the tablets 182 loaded via the loading opening 160 and the actuator in the form of plunger 156, with the exception of having the dispensing opening or outlet 186 provided on the opposite side of the housing from the loading opening 160.

Figure 9:
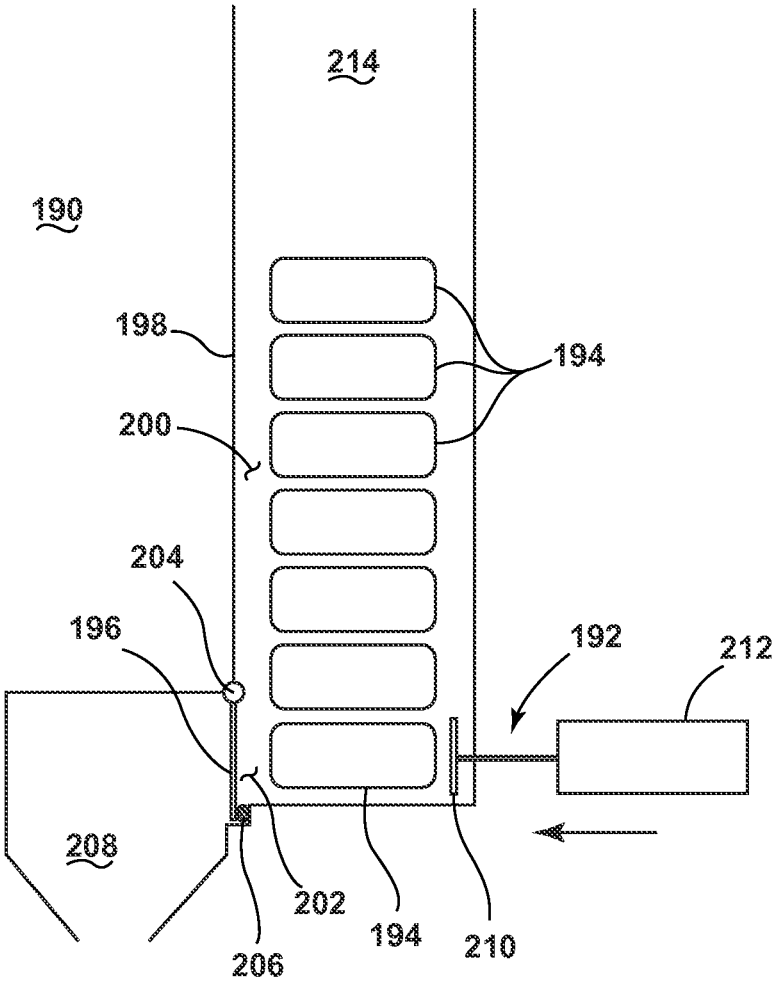
FIG. 9 is a schematic, sectional view of a vertical bulk unit-dose dispenser according to another embodiment of the invention.

FIG. 9 illustrates a vertical dispenser 190 with an actuator 192 that pushes a tablet 194 through a door 196 that seals when not transferring a tablet 194. The dispenser 190 includes a housing 198 which stores a stack of unit-dose tablets 194 in a single column within a storage chamber 200. The tablets 194 can be of identical type, size and composition, or can be dissimilar from each other, including tablets, pods or gel-packs of detergent, rinse aid, or combinations thereof.

The bottom-most tablet 194 in the stack is aligned with an opening 202 in the housing 198 which is normally closed by the door 196, which can be coupled to the housing 198 by a spring-loaded hinge 204. A seal 206 can be provided between the door 196 and the housing 198 at the opening 202 to keep moisture away from the tablets 194 in the housing 198 waiting to be dispensed. The opening 202 leads to a dispensing chute 208 that leads to the treating chamber of a dishwasher. Tablets 194 can be loaded into the housing 198 through a loading opening 214 at an end of the housing opposite the dispensing opening 202. The loading opening 214 can optionally be closed by a cover or door (not shown).

The actuator 192 comprises a plunger 210 controlled by a wax motor or solenoid 212. The plunger 210 is in alignment with the lowermost tablet 194 in the storage chamber 200 and with the door 196. Before, at the start of, or during a cycle, the plunger 210 pushes the lowermost tablet 194 through the door 196 and into the dispensing chute 208. The plunger 210 moves back and the remaining tablets 194 then drop down so the next tablet 194 is in position for a subsequent cycle. In another embodiment, the door 196 can comprise a duck bill which seals after the tablet 194 has been released.

Figure 10:
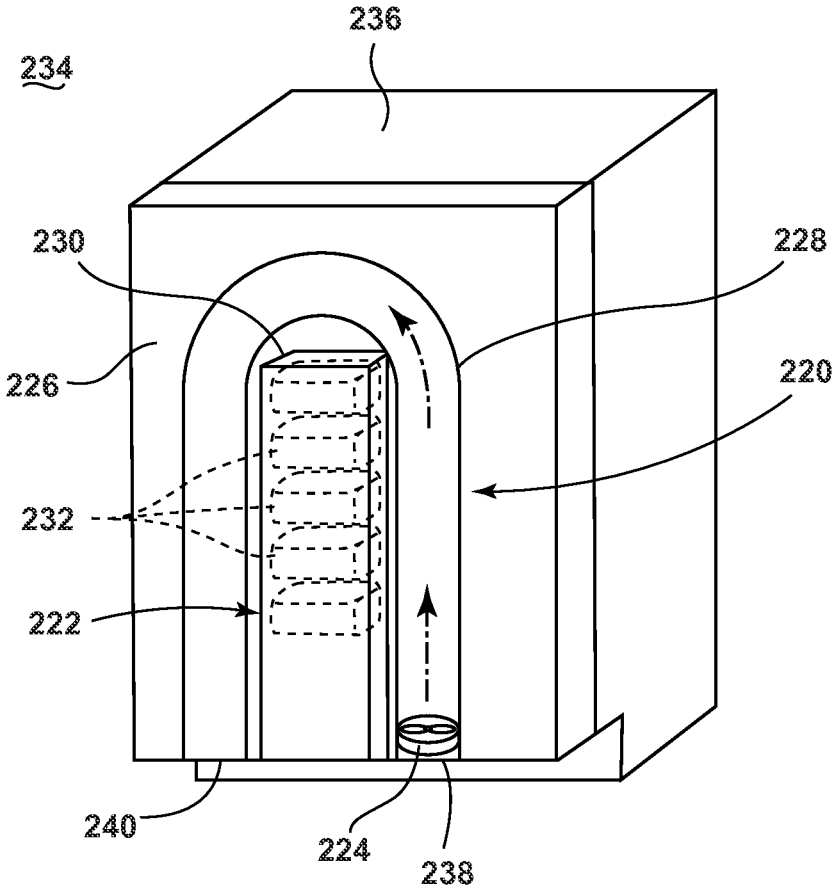
FIG. 10 is a perspective view of a vertical bulk unit-dose dispenser according to another embodiment of the invention.

In FIG. 10, a cooling system 220 for a door-mounted bulk unit-dose dispenser 222 is shown. A cooling fan 224 at the bottom of the dishwasher door 226 pulls air into a duct 228 around the detergent dispenser housing 230 to shield tablets 232 from temperatures during a dishwasher cycle. The air can be ambient cooling air that has a lower temperature than the air in the treating chamber of the dishwasher or around the dispenser 222.

The dishwasher 234 includes a chassis 236 defining an interior of the dishwasher 234 and can include a frame, with or without panels mounted to the frame. The door 226 can be movably mounted to the dishwasher 234 for movement between opened and closed positions to selectively access the treating chamber within the chassis 236. Details of the dishwasher 234 can be identical or similar to those described above with reference to FIG. 1.

The duct 228 can extend around at least the storage portion of the dispensing housing 230, i.e. the portion of the housing 230 holding tablets 232 waiting to be dispensed into the treating chamber. The fan 224 can be located at an inlet 238 or outlet 240 to the duct 228, which are in fluid communication with ambient air, or can be located somewhere along the duct 228 between the inlet and outlet. The fan 224 can be coupled with the controller of the dishwasher 234, such as the controller 50 shown in FIG. 2, for operation during a portion of the cycle of operation or the entire cycle of operation. The fan 224 can further operate for a period of time after a cycle of operation is complete, during which the temperature inside the dishwasher 234 can remain high.

It is noted that any dispenser embodiment disclosed herein can be provided with the cooling system 220, particularly the embodiments of the dispenser which are located in the door of the dishwasher. However, a dispenser mounted outside the door, such as the embodiment shown in FIG. 5 that is mounted to the counter-top above the dishwasher, can also be provided with a similar cooling system 220.

Figure 11:
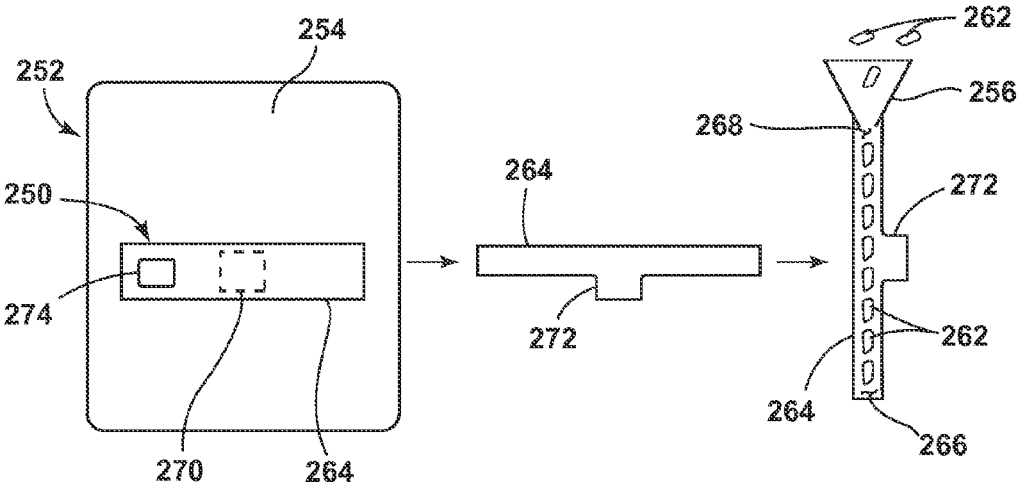
FIG. 11 is a schematic view of a bulk unit-dose dispenser according to another embodiment of the invention.

FIG. 11 shows a bulk unit-dose dispenser 250 that removably docks to a dishwasher door 252. The dispenser 250 is attached to an inside surface 254 of the door 252, i.e. the surface that faces the treating chamber of the dishwasher when the door 252 is closed, and is removably connected such that the dispenser 250 can be removed from the dishwasher to allow easy loading through a funnel 256 of multiple tablets 262. In use, a single tablet 262 is dispensed either at the completion of a cycle or before a cycle.

The dispenser 250 includes a housing 264 defining an elongated storage chamber 266 which receives multiple unit-dose tablets 262. The tablets 262 can be of identical type, size and composition, or can be dissimilar from each other, including tablets, pods or gel-packs of detergent, rinse aid, or combinations thereof. The tablets 262 can be loaded into the storage chamber 266 through a loading opening 268, which can receive the funnel 256 during loading. While not shown, the housing 264 can include a cover or lid for the loading opening 168.

The inside surface 254 of the door 252 can include a dock 270 for receiving a docking member 272 on the housing 264. The dock 270 can mount the dispenser 250 to the door 252 such that the dispenser 250 is carried by the door 252 as it is opened and closed, and can further provide electrical communication between the dispenser 250 and the controller of the dishwasher, such as the controller 50 of FIGS. 1-2.

In use, a single tablet 262 is dispensed to an exit or dispensing opening 274 in the housing 264 either at the completion of a cycle or before a cycle. The dispensing mechanism can comprise, for example, any of the dispensing mechanism described above with respect to FIGS. 6A-9, but is not limited to these particular dispensing mechanisms. It is noted that any dispenser embodiment disclosed herein can be provided with the docking system and funnel-filling system discussed for FIG. 11, particularly the embodiments of the dispenser which are located in the door of the dishwasher. However, a dispenser mounted outside the door, such as the embodiment shown in FIG. 5 that is mounted to the counter-top above the dishwasher, can also be provided with a similar docking system and funnel-filling system.

Figure 12:
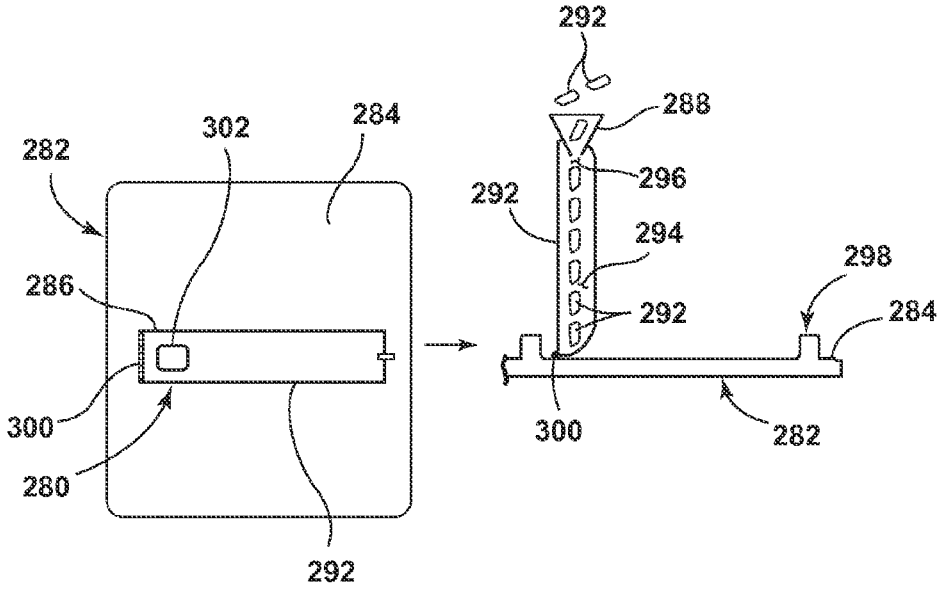
FIG. 12 is a schematic view of a bulk unit-dose dispenser according to another embodiment of the invention.
Figure 13A:
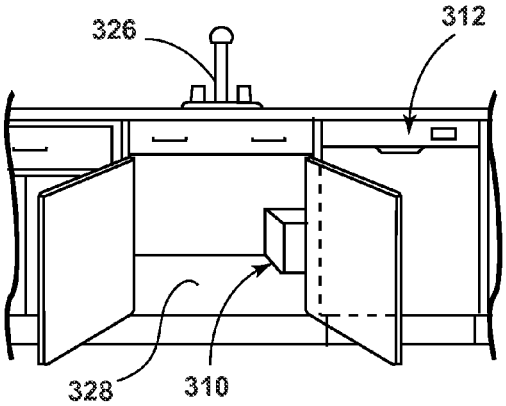
FIGS. 13A-13D are schematic views of a bulk unit-dose dispenser according to another embodiment of the invention.
Figure 13B:
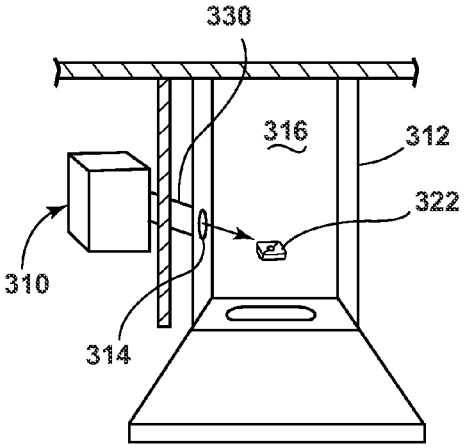
Figure 13C:
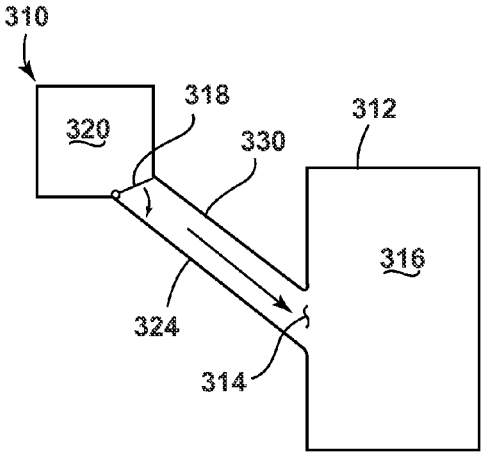
Figure 13D:
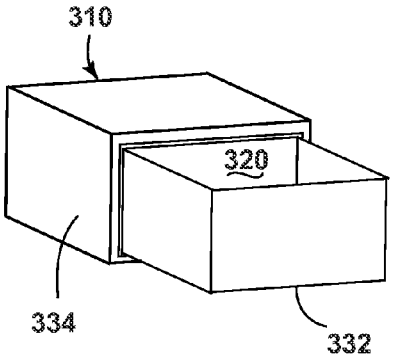

FIG. 12 shows a bulk unit-dose dispenser 280 that docks to a dishwasher door 282. The dispenser 280 is attached at the ends of an inside surface 284 of the door 282, i.e. the surface that faces the treating chamber of the dishwasher when the door 282 is closed, and is pivotably connected at one end 286 such that the dispenser 280 rotates to allow easy loading through a funnel 288. In use, a single tablet 290 is dispensed either at the completion of a cycle or before a cycle.

The dispenser 280 includes a housing 292 defining an elongated storage chamber 294 which receives multiple unit-dose tablets 290. The tablets 290 can be of identical type, size and composition, or can be dissimilar from each other, including tablets, pods or gel-packs of detergent, rinse aid, or combinations thereof. The tablets 290 can be loaded into the storage chamber 294 through a loading opening 296, which can receive the funnel 288 during loading. While not shown, the housing 292 can include a cover or lid for the loading opening 296.

The inside surface 284 of the door 282 can include a dock 298 for receiving the housing 264. The housing 292 can include a pivot 300 on the end 286 of the dispenser 280 to pivotally connect the dispenser 280 to the door 282. When received by the dock 298, the dispenser 280 can be carried against the door 252 as it is opened and closed, and can further provide electrical communication between the dispenser 280 and the controller of the dishwasher, such as the controller 50 of FIGS. 1-2. When pivoted up away from the dock 298, the dispenser 280 can be loaded with tablets 290 via the funnel 288.

In use, a single tablet 290 is dispensed to an exit or dispensing opening 302 in the housing 292 at the completion of a cycle or before a cycle. The dispensing mechanism can comprise, for example, any of the dispensing mechanism described above with respect to FIGS. 6A-9, but is not limited to these particular dispensing mechanisms. It is noted that any dispenser embodiment disclosed herein can be provided with the docking system and funnel-filling system discussed for FIG. 12, particularly the embodiments of the dispenser which are located in the door of the dishwasher. However, a dispenser mounted outside the door, such as the embodiment shown in FIG. 5 that is mounted to the counter-top above the dishwasher, can also be provided with a similar docking system and funnel-filling system.

FIGS. 13A-13D illustrate a under sink drawer bulk unit-dose dispenser 310 coupled to a dishwasher 312. A dispenser 310 is positioned above the inlet 314 to the treating chamber 316 such that a valve or door 318 opens in the hopper 320 to release a tablet 322, and the tablet 322 travels down a steep slope 324 to reach the treating chamber 316. In this location, with the hopper 320 located outside the dishwasher 312 itself, the tablets 322 stored by the hopper 320 are remote from the heat and humidity of the treating chamber 316, which helps preserve the integrity of the tablets 322 while they are stored.

The dishwasher 312 is located next to a sink 326, and the dispenser 310 located under the sink 326 in a cabinet 328 under the sink 326. The dispenser hopper 320 is coupled with the treating chamber 316 of the dishwasher 312 via a duct 330 defining the steep slope 324. The hopper 320 can be defined by a drawer 332 which can be withdrawn from a housing 334 of the dispenser and which can be opened to load tablets 322 into the hopper 320.

In use, a single tablet 322 is dispensed through the duct 330 and into the treating chamber 316 at the completion of a cycle or before a cycle. It is noted that any dispenser embodiment disclosed herein can be accommodated under the sink 326 next to the dishwasher 312, with the dispenser, particularly the storage portion of the dispenser which holds the bulk supply of treating chamber, located under the sink 326.

Figure 14:
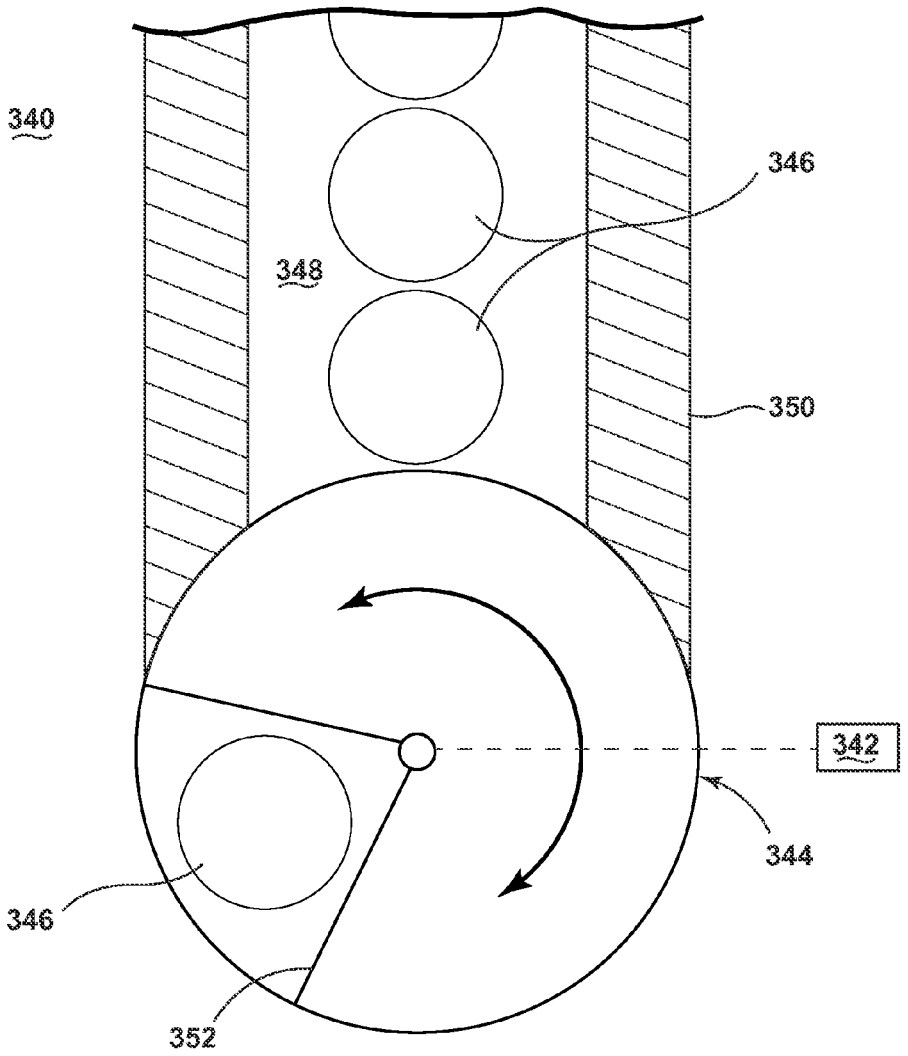
FIG. 14 is a schematic view of a bulk unit-dose dispenser according to another embodiment of the invention.

FIG. 14 shows a bulk unit-dose dispenser 340 in which a wax motor 342 rotates a gate 344 to release a single tablet 346 while sealing the storage chamber 348. The dispenser 340 includes a housing 350 which stores a stack of unit-dose tablets 346 in a single column within the storage chamber 348. The tablets 346 can be of identical type, size and composition, or can be dissimilar from each other, including tablets, pods or gel-packs of detergent, rinse aid, or combinations thereof.

The bottom-most tablet 346 feeds into a transfer chamber 352 in the gate 344, which seals the bottom of the storage chamber 348 to keep moisture away from the tablets 346 in the housing 350 waiting to be dispensed. As the gate 344 rotates around, the tablet 346 in the transfer chamber 352 can be dropped into the treating chamber of the dishwasher, or into a dispensing chute that leads to the treating chamber of a dishwasher, similar to the dispensing chute 208 of FIG. 9. The gate 344 can be configured to rotate completely around, or rotate back and forth between a loading position and a dispensing position.

Figure 15:
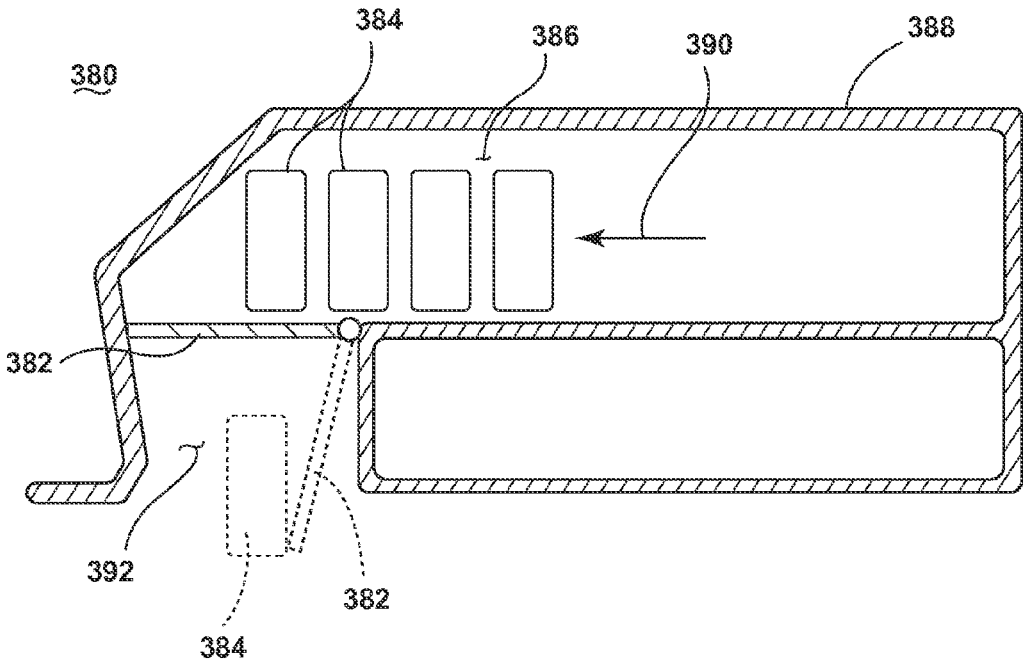
FIG. 15 is a schematic view of a bulk unit-dose dispenser according to another embodiment of the invention.

FIG. 15 shows a bulk unit-dose dispenser 380 which uses a pivoting gate or door 382 to transfer a single tablet 384 while sealing the storage chamber 386. The dispenser 380 includes a housing 388 which defines the elongated storage chamber 386 which receives multiple unit-dose tablets 384. The tablets 384 can be of identical type, size and composition, or can be dissimilar from each other, including tablets, pods or gel-packs of detergent, rinse aid, or combinations thereof. The tablets 384 can be loaded sequentially into the storage chamber 386 through a loading opening (not shown), which can be similar to the loading opening closed by the door shown in FIG. 6B, or can be loading via a funnel according to the embodiments of FIGS. 11-12.

The tablets 384 are moved forward either at the completion of a cycle or before a cycle by an actuator 390. The actuator 390 can include a plunger or pusher biased by a spring and can be controlled by a wax motor or solenoid, similar to the actuator 108 of the embodiment in FIGS. 6A-6C. The end of the storage chamber 386 opposite the actuator 390 can include a transfer opening 392 that is normally closed by the door 382 and which leads to the treating chamber of the dishwasher, or into a dispensing chute that leads to the treating chamber of a dishwasher, similar to the dispensing chute 208 of FIG. 9. In the closed position the door 382 can seal the storage chamber 386 to keep moisture away from the tablets 384 in the housing 388 waiting to be dispensed.

Figure 16:
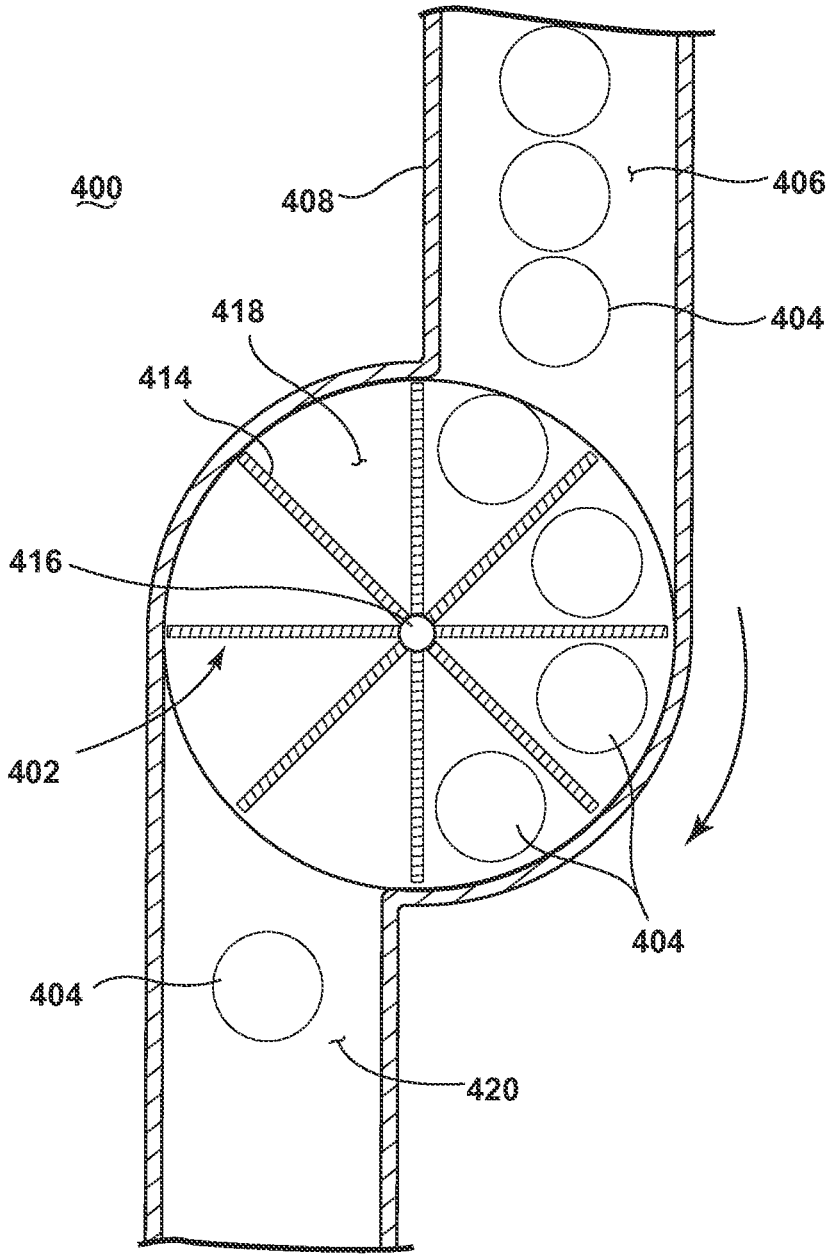
FIG. 16 is a schematic view of a bulk unit-dose dispenser according to another embodiment of the invention.

FIG. 16 shows a bulk unit-dose dispenser 400 which uses a turnstile door 402 to transfer a single tablet 404 while sealing the storage chamber 406. The dispenser 400 includes a housing 408 which defines the elongated storage chamber 406 which receives multiple unit-dose tablets 404 in a single column stack. The tablets 404 can be of identical type, size and composition, or can be dissimilar from each other, including tablets, pods or gel-packs of detergent, rinse aid, or combinations thereof. The tablets 404 can be loaded sequentially into the storage chamber 406 through a loading opening (not shown), which can be similar to the loading opening closed by the door shown in FIG. 6B, or can be loading via a funnel according to the embodiments of FIGS. 11-12.

The turnstile door 402 includes a plurality of gates 414 rotatable about a central point 416 defining a rotational axis for the door 402. The gates 414 define a plurality of transfer chambers 418 sized to accommodate a single tablet 404 at a time. The turnstile doors 402 also provide a seal for the housing 408 to keep moisture away from the tablets 404 in the storage chamber 406 waiting to be dispensed.

In operation, as the turnstile doors 402 rotate, the bottom-most tablet 404 in the storage chamber 406 aligns with an empty transfer chamber 418 and is carried by the turnstile door 402 into alignment with a transfer opening 420. The tablet 404 can fall by gravity into the transfer opening 420, which in turn leads to the treating chamber of the dishwasher, or into a dispensing chute that leads to the treating chamber of a dishwasher, similar to the dispensing chute 208 of 9.

Figure 17:
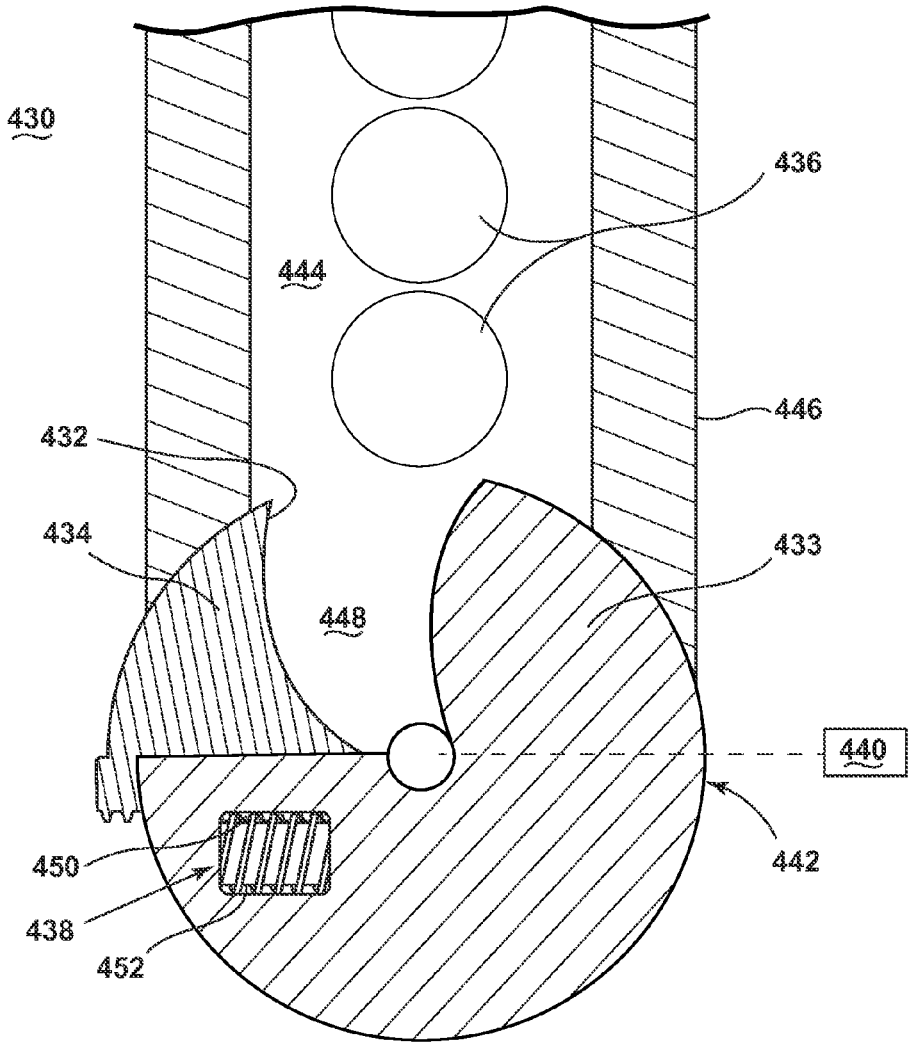
FIG. 17 is a schematic view of a bulk unit-dose dispenser according to another embodiment of the invention.

In FIG. 17, another turnstile bulk unit-dose dispenser 430 is illustrated. The opening 432 between the fingers 433, 434 is sized such that only a single tablet 436 fits. It can include a dial or other actuator 438 that will adjust the size of the opening 432.

The bulk unit-dose dispenser 430 can be similar to the bulk unit-dose dispenser 340 shown in the embodiment of FIG. 14, save for being provided with an adjustable compartment size. The dispenser 430 includes a wax motor 440 that rotates a gate 442 to release a single tablet 436 while sealing a storage chamber 444. The dispenser 430 includes a housing 446 which stores a stack of unit-dose tablets 436 in a single column within the storage chamber 444. The tablets 436 can be of identical type, size and composition, or can be dissimilar from each other, including tablets, pods or gel-packs of detergent, rinse aid, or combinations thereof.

The gate 442 includes at least one transfer chamber 448 defined by the fingers 433, 434. The size of the transfer chamber 448 may be defined by the size of the opening 432 into the transfer chamber 448. The fingers 433, 434, include a fixed finger 433 and a moveable finger 434 adapted to slide relative to the fixed finger 433 in order to adjust the size of the opening 432. The moveable finger 434 can include a toothed section 450 which cooperates with the actuator 438, which comprises an adjustment screw 452 or the like having external threads in the illustrated embodiment. The moveable finger 434 will slide relative to the fixed finger 433 in response to rotation of the adjustment screw 452 along the toothed section 450.

The bottom-most tablet 436 feeds into a transfer chamber 448 in the gate 442, which seals the bottom of the storage chamber 444 to keep moisture away from the tablets 436 in the housing 446 waiting to be dispensed. The wax motor 440 can be operably coupled with the fixed finger 433 for rotation of the gate 442 during a dispensing operation. As the gate 442 rotates around, the tablet 436 in the transfer chamber 448 can be dropped into the treating chamber of the dishwasher, or into a dispensing chute that leads to the treating chamber of a dishwasher, similar to the dispensing chute 208 of FIG. 9. The gate 442 can be configured to rotate completely around, or rotate back and forth between a loading position and a dispensing position.

Other actuators 438 and mechanisms for adjusting the size of the opening 432 are possible. For example, the transfer chamber 448 can be defined by a fixed finger and a sliding finger, with detents to hold the sliding finger in place.

Figure 18:
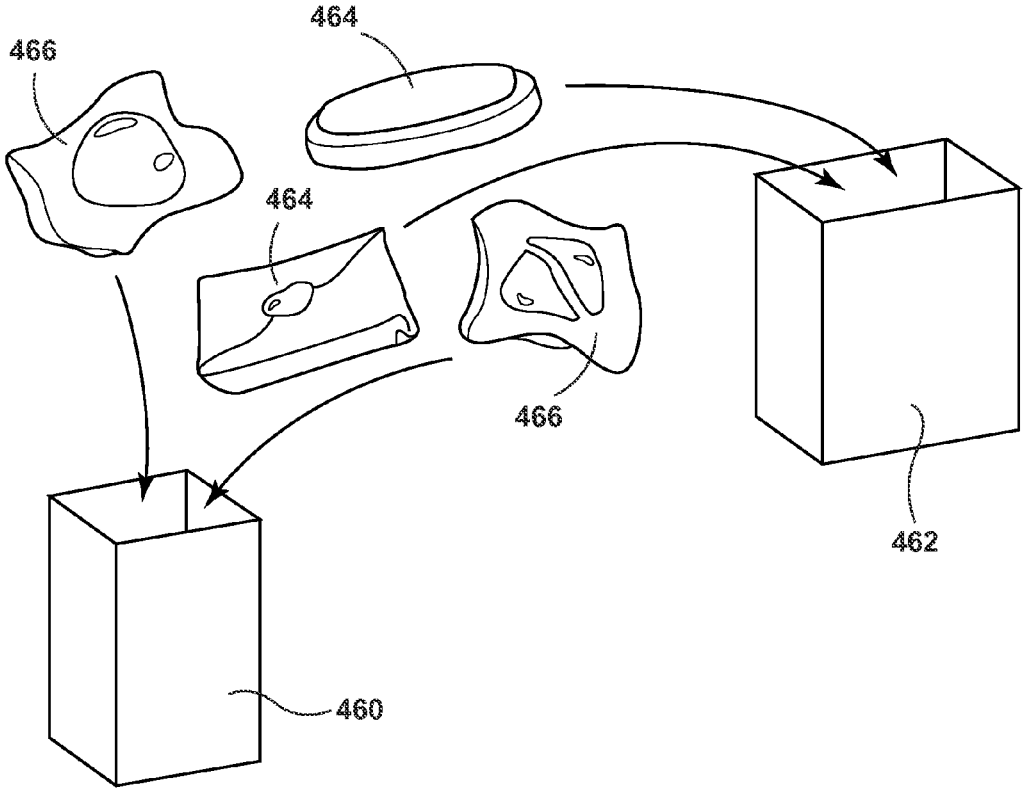
FIG. 18 is a perspective view of a bulk unit-dose dispenser according to another embodiment of the invention.

FIG. 18 illustrates magazines or cartridges 460, 462 for various sizes and shapes of tablets 464 and pods 466. In any of the dispenser embodiments disclosed herein, multiple magazines or cartridges 460, 462 can be provided for storing different sizes and shapes of unit-doses of treating chemistry, particularly the embodiments of the dispenser which have a removable storage chamber, such as the bulk unit-dose dispenser 250 that removably docks to a dishwasher door 252 in 11. A user can select which magazine or cartridge 460, 462 to fill based on the type of treating chemistry they want to use, load it with tablets 464 or pods 466 of treating chemistry, and couple it with the dishwasher.

Figure 19A:
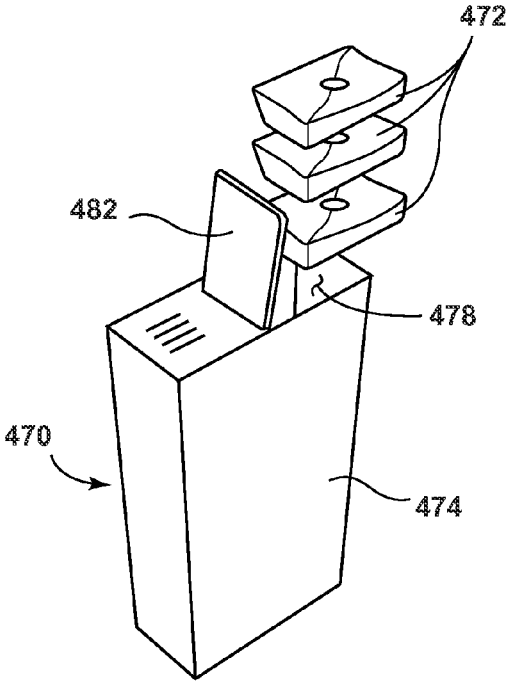
FIG. 19A is a perspective view of a bulk unit-dose dispenser according to another embodiment of the invention.
Figure 19B:
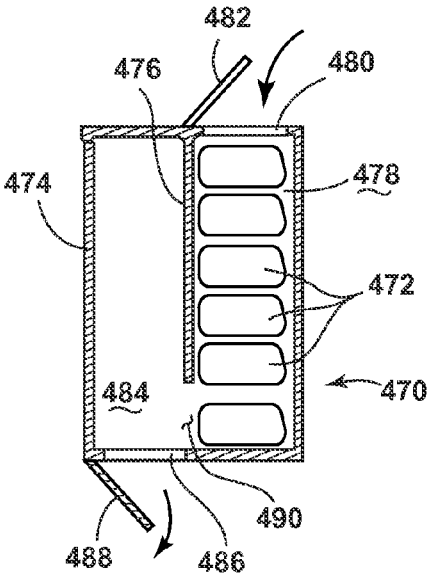
FIG. 19B is a sectional view of the bulk unit-dose dispenser from FIG. 19A.

FIGS. 19A-19C shows a vertical bulk unit-dose dispenser 470 in which tablets 472 are loaded through the top and stored on one side. A single tablet 472 is moved to the opposite side for dispensing.

The dispenser 470 includes a housing 474 divided into two sides by a partition 476. One side defines an elongated storage chamber 478 which receives multiple unit-dose tablets 472. The tablets 472 can be of identical type, size and composition, or can be dissimilar from each other, including tablets, pods or gel-packs of detergent, rinse aid, or combinations thereof. The tablets 472 can be loaded sequentially into the storage chamber 478 through a loading opening 480 closed by a cover 482, such that the unit-dose tablets 472 are stacked in a single column within the storage chamber 478. The other side of the housing 474 defines a dispensing chamber 484 which includes a dispensing opening 486 closed by a cover 488. The end of the storage chamber 478 opposite the loading opening 480 can include a transfer opening 490 leading to the dispensing chamber 484. The transfer opening 490 can be sized to allow one tablet 472 into the dispensing chamber 484 at a time. The bottom-most tablet 472 in the stack is aligned with the transfer opening 490.

The dispenser 470 can be provided with an actuator (not shown), such as the actuator 192 from 9, that can push the bottom-most tablet 472 in the stack through the transfer opening 490 and into the dispensing chamber 484. Before, at the start of, or during a cycle of operation, the cover 488 is opened to permit the tablet 472 in the dispensing chamber 484 to fall by gravity through the dispensing opening 486 and into the treating chamber of the dishwasher.

Figure 20A:
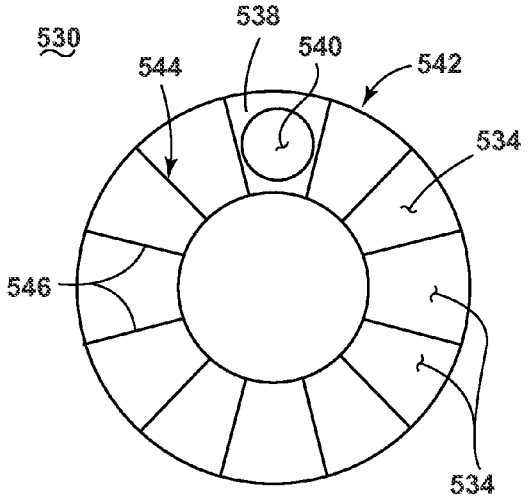
FIGS. 20A-20C are schematic views of a bulk unit-dose dispenser according to another embodiment of the invention.
Figure 20B:
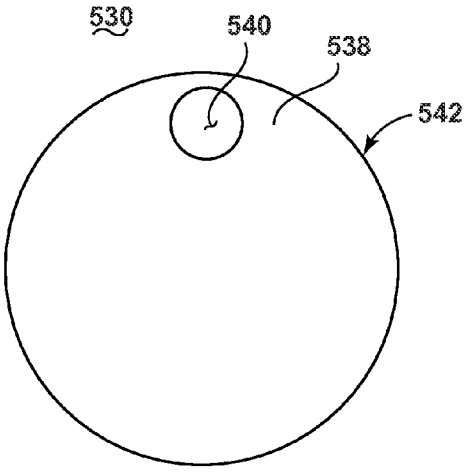
Figure 20C:
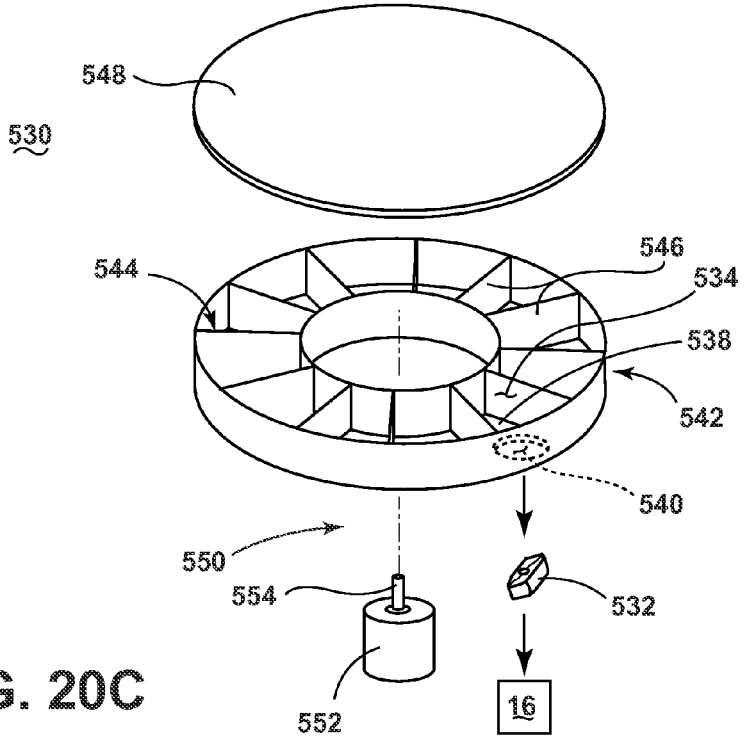

FIGS. 20A-20C shows a circular indexing bulk unit-dose dispenser 530. In this embodiment, a single tablet is loaded into each compartment 534 of a storage chamber 536. The bottom 538 of the dispenser 530 has a single opening 540 to allow a tablet to enter the treating chamber 16 (FIG. 1). The storage chamber 536 indexes one location per cycle.

The dispenser 530 includes a housing 542 defining the storage chamber 536, which is divided into the plurality of compartments 534 near the circumference of the housing by a hopper 544 having multiple radial partitions 546. In the illustrated embodiment, the individual compartments 534 are evenly divided amongst the circular, disk-like footprint of the hopper, but in other embodiments the compartments 534 can be differently-sized to accommodate differently-sized tablets. In still further embodiments, the compartments 534 can be either radially or spirally arranged.

The bottom 538 of the housing 542 includes the dispensing opening 540 and the top of the housing is defined by an openable lid or cover 548. The storage chamber 536 receives multiple unit-dose tablets. The tablets can be of identical type, size and composition, or can be dissimilar from each other, including tablets, pods or gel-packs of detergent, rinse aid, or combinations thereof. The tablets can be loaded into the storage chamber 536 by removing or opening the cover 548. The dispenser 530 can be removably received on the door assembly 18 of the dishwasher 10 (FIG. 1) so that it can be removed from the door assembly 18 and loaded in a convenient location, such as on a countertop. At least a portion of the cover 548 can be clear or transparent so that a user can see whether tablets are present or absent in the compartments 534 without having the remove the cover 548 from the housing 542, or the dispenser 530 from the dishwasher in the case where the dispenser 530 is removable.

The hopper 544 can rotate relative to the bottom 538 of the housing 542; specifically, the hopper 544 can index once per cycle to sequentially bring one of the compartments 534 into registry with the dispensing opening 540. A drive mechanism 550 can be operably coupled with the hopper 544 to rotate the hopper 544 relative to the bottom 538 of the housing 542. The drive mechanism 550 can include motor 552 with a shaft 554 operably coupled to the hopper 544 for imparting rotational indexing movement to the hopper 544. The motor 552 can be electrically coupled with the controller 50 of the dishwasher 10 (FIG. 1-2) such that the hopper 544 is indexed one location each cycle of operation. Alternatively, the bottom 538 of the housing 542 can index relative to the hopper 544, such that the dispensing opening 540 moves in a circular path from compartment to compartment.

The dispensing opening 540 can be open to the treating chamber 16, such that the tablet can fall into the treating chamber 16 by gravity as the hopper 544 is indexed. Alternatively a door (not shown) can be provided on the dispensing opening 540 that is configured to be opened during a cycle to release the tablet from the compartment 534.

FIGS. 21A-21D illustrates a circular bulk unit-dose pill box dispenser 560 that docks or snaps on to an existing dispenser 562 on an inner side 564 of a door 566 of a dishwasher, such as the dishwasher 10 of FIGS. 1-2. Unit-dose tablets 568 are placed along the circumference of a disc-shaped carousel 570. The dispenser 560 can be undocked or unsnapped from the door 566 to allow a consumer to place the dispenser 560 in an easy location for loading. The cover 572 can be unscrewed when loading. Once loaded and snapped onto a current dispenser 562, a wax motor 574 allows the disc-shaped carousel 570 to move one compartment 578 at a time to release a single unit dose tablet 568 with each cycle through a hole 576. The tablet 568 can fall into the treating chamber of the dishwasher or be rinsed out of the compartment 578 by a spray from the dishwasher wash system can be directed at the hole 576.

A magnet 580 can be used for more precise dispensing. The magnet 580 is located in the door 566 behind the dispenser 560. A pin 582 holds the position of the carousel 570 in the bulk unit-dose dispenser 560. The magnet 580 moves inside the door 566 and actuates the pin 582 holding the carousel 570 to allow the carousel 570 to move one position to dispense a single tablet 568 at the right time during the cycle.

The carousel 570 defines a storage chamber 584 which receives multiple unit-dose tablets 568. The tablets 568 can be of identical type, size and composition, or can be dissimilar from each other, including tablets, pods or gel-packs of detergent, rinse aid, or combinations thereof. The tablets 568 can be loaded into the storage chamber 584 by removing or opening the cover 572 on the carousel 570. The cover 586 includes a single dispensing opening 588 aligned with the hole 576, which is open to the inner periphery of the disc-shaped carousel 570 received around the existing dispenser 562.

By docking the bulk dispenser 560 onto the existing dispenser 562, an existing dishwasher can be provided with bulk dispensing capability and no openings or holes need to be added to the door for dispensing. The illustrated dispenser 560 snaps on to the existing dispenser 562, which can be a dispenser configured to hold a single dose of treating chemistry that is filled each time a user runs a cycle in the dishwasher. Tabs 590 can be pressed to unsnap the dispenser 560 from the existing dispenser 562.

Figure 21A:
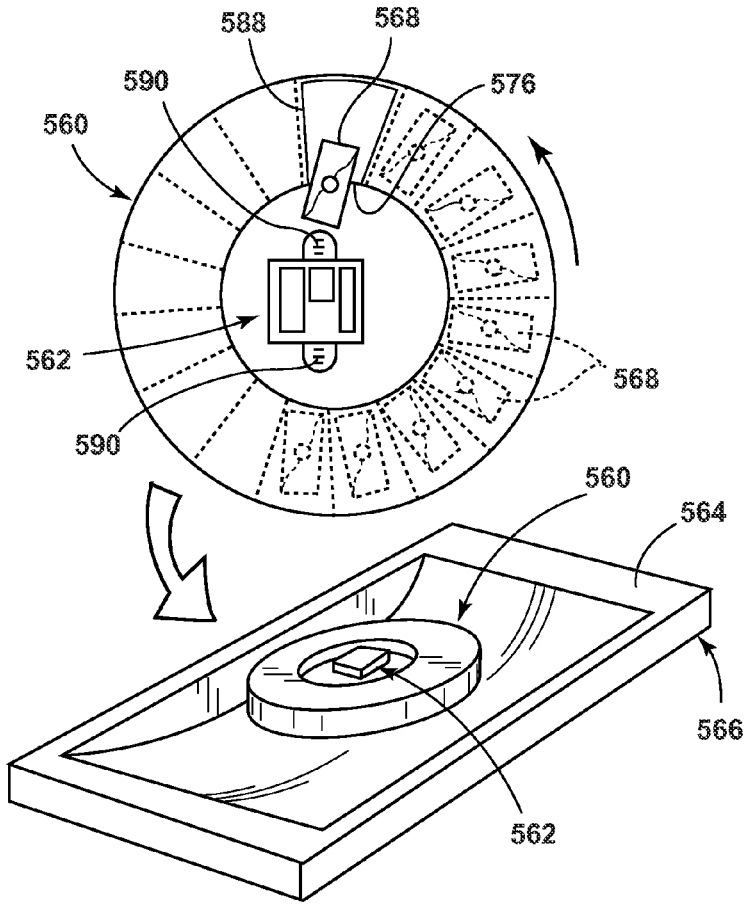
FIGS. 21A-21D are schematic views of a bulk unit-dose dispenser according to another embodiment of the invention.
Figure 21B:
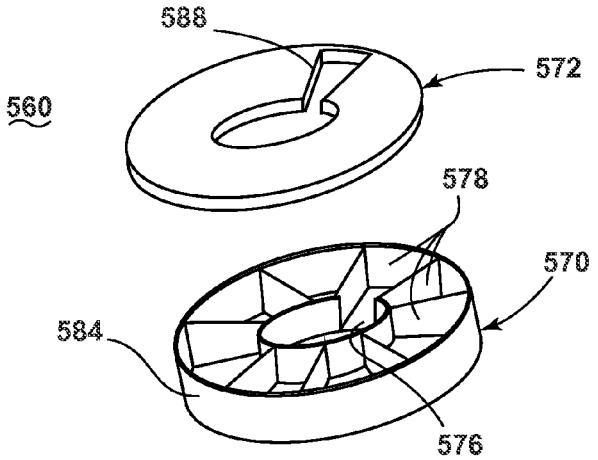
Figure 21C:
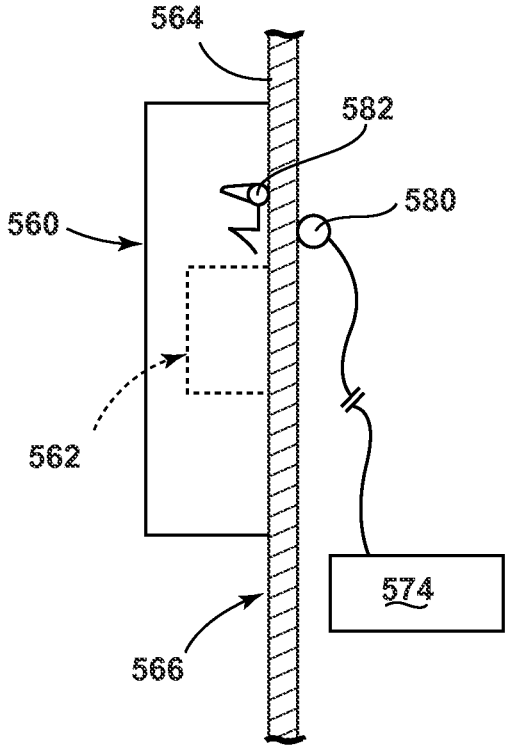
Figure 21D:
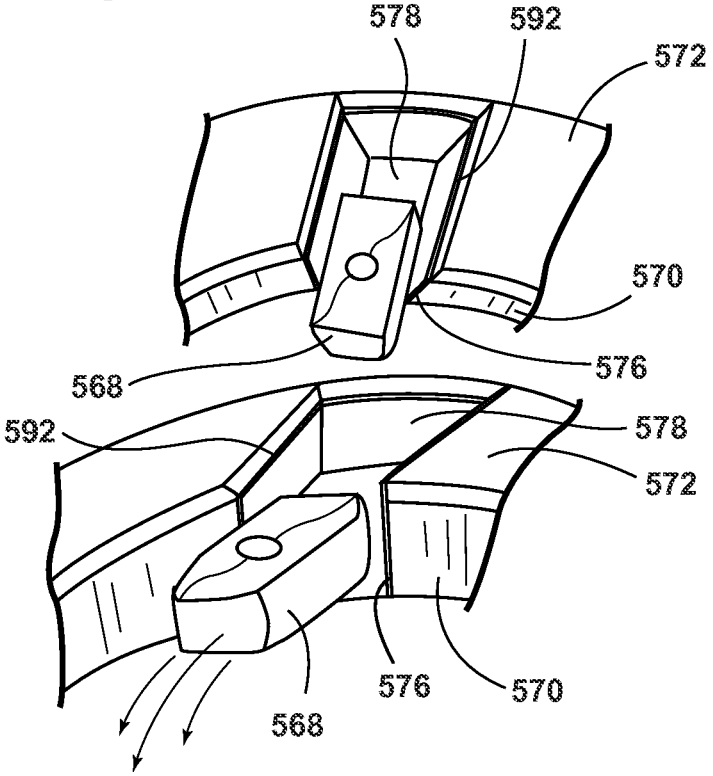

Referring to FIG. 21D, a seal 592, such as a duck bill seal, can be provided between the cover 572 and the carousel 570 to prevent humidity and moisture from reaching the compartments 578 which are not actively dispensing a tablet 568.

Figure 22:
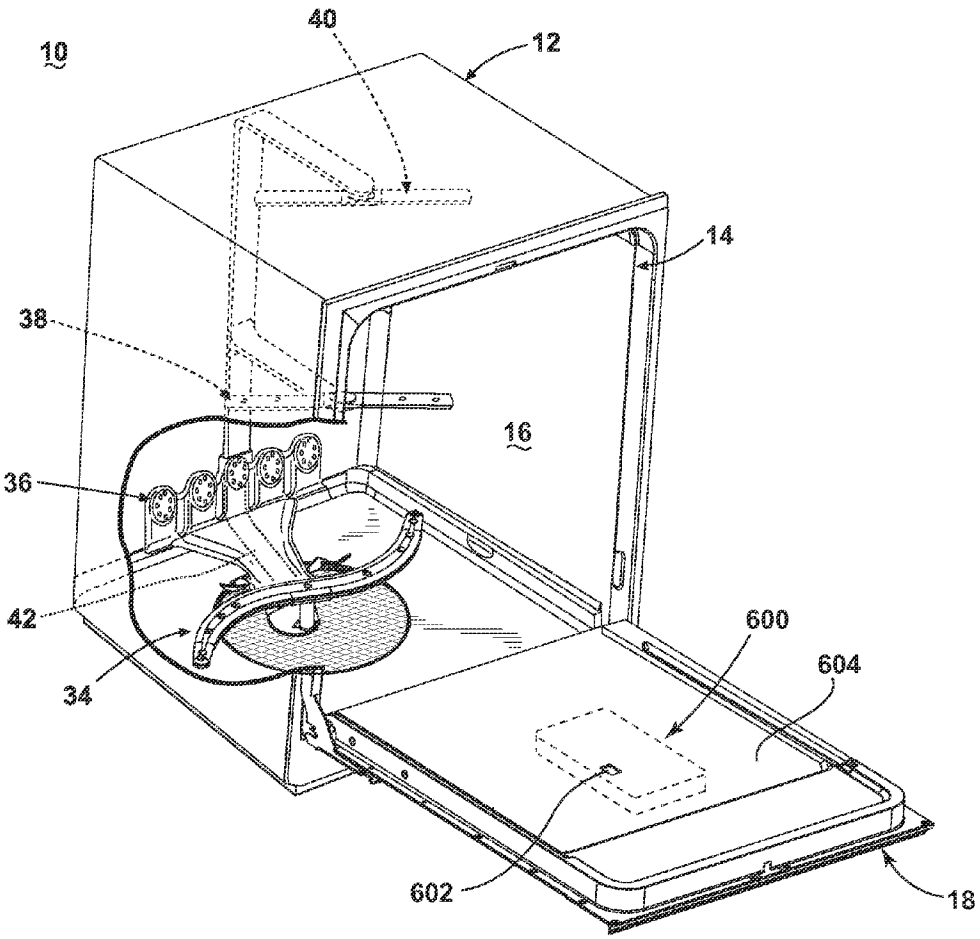
FIG. 22 is a perspective view of a dishwasher having a bulk unit-dose dispenser according to another embodiment of the invention.

FIG. 22 is a perspective view of the dishwasher 10 of FIGS. 1-2 having a bulk unit-dose dispenser 600 according to another embodiment of the invention. The bulk-unit dose dispenser 600 can be similar to the bulk unit-dose dispenser of FIGS. 3A-4. In FIG. 22, the door assembly 18 is shown in an open position in which the treating chamber 16 can be accessed. The bulk-unit dose dispenser 600 can be carried by the door assembly 18 of the dishwasher 10, and can be configured to remain in the door assembly 18 when loading the dispenser 600, or can be removable from an inner surface or wall 604 of the door assembly 18 for loading. The dispenser 600 can further be configured to dispense a tablet into the treating chamber 16 or to have a tablet rinsed out of a dispensing opening 602 by liquid emitted from one or more of the liquid sprayers 34, 36, 38, 40. The dispenser 600 can be designed to dispense unit dose pods or tablets of identical type, size and composition, or tablets that can be dissimilar from each other, including tablets, pods or gel-packs of detergent, rinse aid, or combinations thereof.

Figure 23:
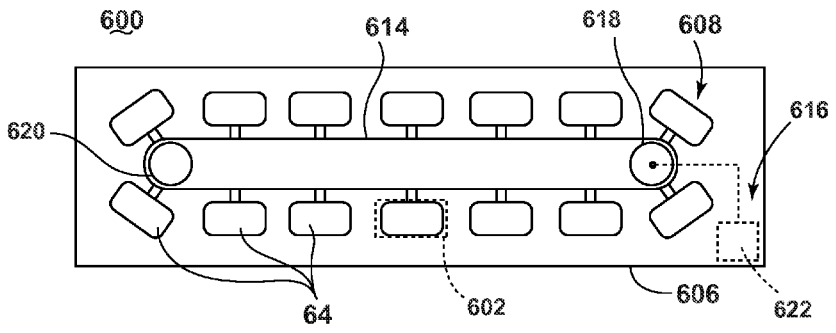
FIG. 23 is a schematic top view of the dispenser from FIG. 22.

FIG. 23 is a schematic top view of the dispenser 600. The bulk-unit dose dispenser 600 includes a housing 606, which includes the dispensing opening 602 that is open to the treating chamber 16 (FIG. 22), a track mechanism 608 within the housing 606, and a plurality of compartments 610 moving along the track mechanism 608, with the compartments 610 configured to each receive an individual unit-dose of a treating chemistry, such as a pod or tablet 612. The compartments 610 can be moved along the track mechanism 608 into sequential registry with the dispensing opening 602.

The track mechanism 608 can include a track 614 having a continuous path, as shown, or a linear path that reciprocates back and forth relative to the dispensing opening 602. The path can be circular, or elongated as shown. The track 614 can include 16-20 compartments 610, although it can include less than 16 or more than 20 compartments 610. Preferably, the compartments 610 are sized to fit most commercially available detergent tablets and pods. The track 614 is driven by a drive mechanism 616 and advances the compartments 610 to the single dispensing opening 602. The dispensing opening 602 can be open to the treating chamber 16. In another embodiment, the dispenser opening 302 can be covered by a lid (not shown) when tablets 612 are not being loaded or dispensed. The lid can be similar to the lid shown in FIG. 3C and can be slidably or rotatably connected to the housing 606 or to the inner wall 604 of the door assembly 18.

The track 614 can comprise a conveyor belt carrying the plurality of compartments 610. The drive mechanism 616 includes at least two drums or pulleys 618, 620 about which the conveyor belt rotates, with at least one of pulleys being powered. In the illustrated embodiment, a drive pulley 618 and an idler pulley 620 are provided, with the drive pulley 618 powered by a motor 622. Other drive mechanisms for advancing the conveyor belt are possible, such as a solenoid.

Figure 24:
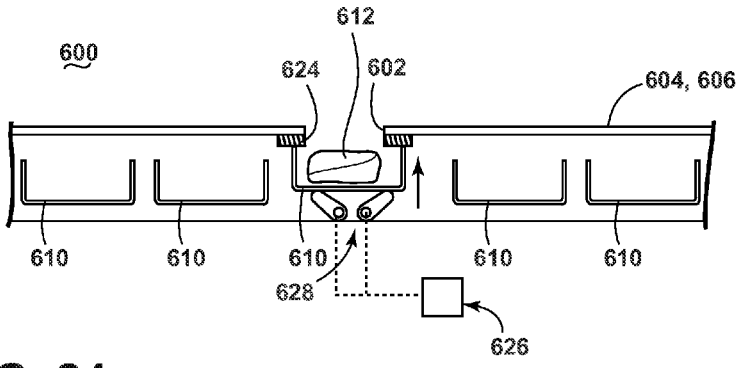
FIG. 24 is a schematic side view of the dispenser from FIG. 22.

FIG. 24 is a schematic side view of the dispenser 600. The housing 606 can be at least partially defined by the inner wall 604 of the door assembly 18 that faces the treating chamber 16 when the door is closed, with the dispensing opening 602 provided in the inner wall 604. The dispenser 600 can be configured to remain in the door assembly 18 when loading the dispenser 600, with the dispensing opening 602 used for sequentially loading the compartments 610. In another example, the housing 606 can be removable from the door assembly 18 for loading. The housing 606 can then be returned to the treating chamber 16 and snapped/latched into place, which re-engages the dispenser drive mechanism 616.

The dispenser 600 can be sealed to prevent humidity and moisture from reaching the compartments 610 when not actively dispensing a tablet 612. One compartment 610 at a time is in registry with the dispensing opening 602 and is ready to dispense. The active or in-register compartment 610 is pressed against a seal 624 around the perimeter of the dispensing opening 602 to place the compartment 610 in sealed fluid communication with the treating chamber 16. Sealing is accomplished by pushing/raising the compartment 610 to engage the seal 624 on the housing 606. In another example, the top edge of each compartment 610 can be provided with a seal that is engaged with the underside of the housing 606 to seal the perimeter of the dispensing opening 602.

During a dishwasher cycle, the compartment 610 used in that cycle is sealed to the housing 606. A spray from the dishwasher wash system can be directed at the single dispensing opening 602 to rinse the compartment. At the conclusion of a cycle, or just before the start of a new cycle, the dispensing compartment 610 is lowered to break the seal, and the track 614 is advanced to bring the next compartment 610 containing a tablet 612 into registry with the dispensing opening 602. The drive mechanism 616 for advancing the track 614 and sealing the dispensing compartment 610 can be operated by a single actuator or by multiple actuators. In the illustrated embodiment, a separate actuator 626 is provided for moving the compartment 610 in registry with the dispensing opening 602 into sealed engagement with the dispensing opening 602. The actuator 626 can include a wax motor or solenoid that moves a platform 628, such as a pair of arms, which moves the compartment 610 in alignment with the opening 602 into sealing engagement with the opening 602.

Figure 25:
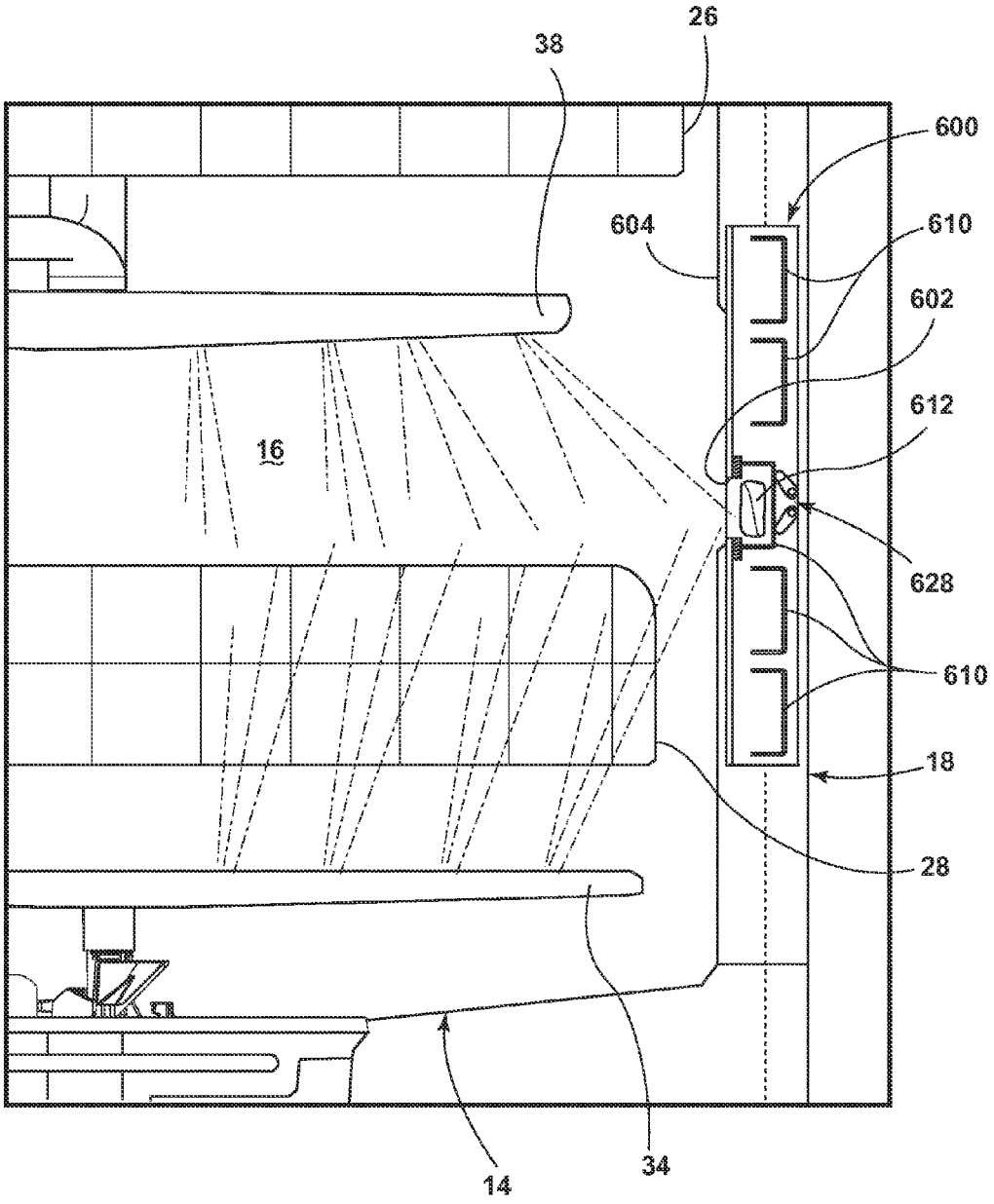
FIG. 25 is a schematic view of the dispensing operation during a dishwasher cycle for the dishwasher of FIG. 22.

FIG. 25 is a schematic view of the dispensing operation during a dishwasher cycle for the dishwasher 10 of FIG. 22. The emitted liquid from one or more of the liquid sprayers 34, 36, 38, 40, such as from the lower sprayer 34, rinses a unit-dose of treating chemistry from the compartment 610 in register with the dispensing opening 602 into the treating chamber 16 through the dispensing opening 602. Depending on the type of liquid sprayer, the emitted liquid can define a spray path that continuously or intermittently intersects with the dispensing opening 602. For example, the lower sprayer 34 can be a rotating spray arm, such that the spray path temporarily intersects the dispensing opening 602 with each rotation of the spray arm. Other types of liquid sprayers, such as a stationary nozzle, can emit a spray of liquid that continuously intersects the dispensing opening 602.

Figure 26:
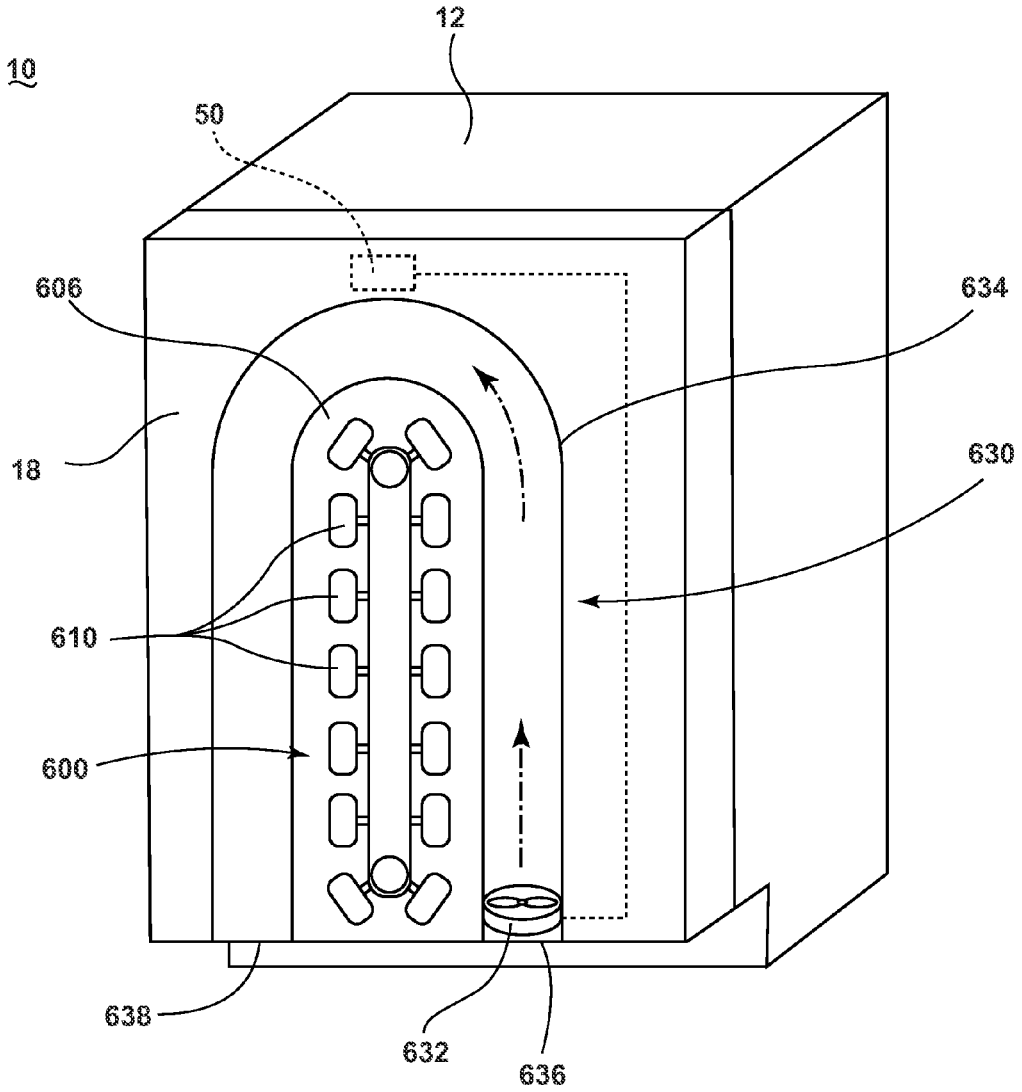
FIG. 26 is a schematic view showing a cooling system of the dishwasher of FIG. 23.

FIG. 26 is a schematic view showing a cooling system of the dishwasher 10. The dishwasher 10 can further include a cooling system 630 for the dispenser 600. The cooling system 630 can be substantially similar to the cooling system shown in FIG. 10, and includes a cooling fan 632 at the bottom of the door assembly 18 that pulls ambient air into a duct 634 around the dispenser housing 606 to shield the unit-doses of treating chemistry within the compartments 610 from temperatures during a dishwasher cycle. The air can be ambient cooling air that has a lower temperature than the air in the treating chamber 16 of the dishwasher 10 or around the dispenser 600.

The duct 634 can extend around at least the storage portion of the dispensing housing 606, i.e. the portion of the housing 606 holding tablets waiting to be dispensed into the treating chamber. The fan 632 can be located at an inlet 636 or outlet 638 to the duct 634, which are in fluid communication with ambient air, or can be located somewhere along the duct 634 between the inlet 636 and outlet 638. The fan 632 can be coupled with the controller 50 of the dishwasher 10 for operation during a portion of the cycle of operation or the entire cycle of operation. The fan 632 can further operate for a period of time after a cycle of operation is complete, during which the temperature inside the dishwasher 10 can remain high.

All of the dispensers discussed above can be insulated to protect the unit-dose tablets from the temperatures during a dishwasher cycle. The dispensers can also be sealed to protect the unit-dose tablets from humidity during the dishwasher cycle. Further, while the bulk unit-dose dispensers are discussed with respect to implementation in a dishwasher, other household appliances may also be provided with the disclosed bulk unit-dose dispensers. For example, a clothes washing machine may be provided with one of the embodiments of the bulk unit-dose dispensers disclosed herein.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A household appliance comprising:

a treating chamber;

a liquid sprayer emitting liquid into the treating chamber; and a bulk unit-dose dispenser mounted on the appliance comprising:

a housing having a dispensing opening that is open to the treating chamber;

a track within the housing wherein the track comprises a continuous loop; and a plurality of compartments moving along the track, with the compartments configured to each receive an individual unit-dose of a treating chemistry;

wherein the compartments can be moved along the track into sequential registry with the dispensing opening, and the emitted liquid from the liquid sprayer rinses a unit-dose of treating chemistry from the compartment into the treating chamber through the dispensing opening.

2. The household appliance of claim 1 and further comprising a chassis, a tub provided within the chassis and at least partially defining the treating chamber, and a door assembly moveably mounted to the chassis between an open position in which the treating chamber can be accessed and a closed position.

3. The household appliance of claim 2, wherein the bulk unit-dose dispenser is located within the door assembly and the housing at least partially defined by a wall of the door assembly that faces the treating chamber when the door is in the closed position, with the dispenser opening provided in the wall.

4. The household appliance of claim 3, wherein at least a portion of the bulk unit-dose dispenser is removably mounted to the door assembly.

5. The household appliance of claim 1, wherein the track further has an elongated path.

6. The household appliance of claim 1, wherein the bulk unit-dose dispenser further comprises a dispenser drive mechanism coupled with the track that sequentially advances the compartments.

7. The household appliance of claim 6, wherein the dispenser drive mechanism comprises one of a wax motor or a solenoid.

8. The household appliance of claim 1, wherein the bulk unit-dose dispenser further comprises a lid selectively covering the dispensing opening.

9. The household appliance of claim 8, wherein the bulk unit-dose dispenser further comprises an advancing mechanism coupled with the lid such that opening the lid sequentially advances the compartments.

10. The household appliance of claim 8, wherein the bulk unit-dose dispenser further comprises a seal on the lid against which the compartment in registry with the dispensing opening is sealed.

11. The household appliance of claim 1, wherein the bulk unit-dose dispenser further comprises a seal on the housing against which the compartment in registry with the dispensing opening is sealed.

12. The household appliance of claim 11, wherein the bulk unit-dose dispenser further comprises a dispenser drive mechanism coupled with the track that sequentially advances the compartments into registry with the dispensing opening and engages the compartments with the seal.

13. The household appliance of claim 1, wherein the track comprises a conveyor belt carrying the plurality of compartments.

14. The household appliance of claim 13, wherein the track further comprises at least two pulleys about which the conveyor belt rotates.

15. The household appliance of claim 1, wherein the bulk unit-dose dispenser is configured to dispense multiple predetermined types of unit-doses.

16. The household appliance of claim 1 and further comprising a door assembly selectively closing the treating chamber, wherein the bulk unit-dose dispenser is carried by the door assembly.

17. The household appliance of claim 1, wherein the emitted liquid from the liquid sprayer defines a spray path, with at least part of the spray path at least temporarily intersecting the dispensing opening.

18. The household appliance of claim 1, and further comprising a cooling system providing cooling air to the bulk unit-dose dispenser.

19. The household appliance of claim 18, wherein the cooling system comprises a cooling fan in fluid communication with ambient air.

20. A household appliance comprising:

a treating chamber defined by at least one wall having a dispensing opening;

a liquid sprayer emitting liquid into the treating chamber; and a bulk unit-dose dispenser mounted on the appliance and comprising a track and a plurality of compartments moving along the track, with the compartments configured to each receive an individual unit-dose of a treating chemistry, wherein the track comprises a continuous loop;

wherein the compartments can be moved along the track into sequential registry with the dispensing opening, and the emitted liquid from the liquid sprayer rinses a unit-dose of treating chemistry from the compartment into the treating chamber.

21. The household appliance of claim 20 and further comprising a chassis, a tub provided within the chassis and at least partially defining the treating chamber, and a door assembly moveably mounted to the chassis between an open position in which the treating chamber can be accessed and a closed position.

22. The household appliance of claim 21, wherein the door assembly comprises an inner wall that faces the treating chamber when the door is in the closed position, and wherein the bulk unit-dose dispenser is carried by the door assembly, with the dispenser opening provided in the inner wall.

23. The household appliance of claim 22, wherein at least a portion of the bulk unit-dose dispenser is removably mounted to the door assembly.

24. The household appliance of claim 21, wherein the track further has an elongated path.

25. The household appliance of claim 20, wherein the bulk unit-dose dispenser further comprises a dispenser drive mechanism coupled with the track that sequentially advances the compartments.

26. The household appliance of claim 25, wherein the dispenser drive mechanism comprises one of a wax motor or a solenoid.

27. The household appliance of claim 20, wherein the bulk unit-dose dispenser further comprises a lid selectively covering the dispensing opening.

28. The household appliance of claim 27, wherein the bulk unit-dose dispenser further comprises an advancing mechanism coupled with the lid such that opening the lid sequentially advances the compartments.

29. The household appliance of claim 27, wherein the bulk unit-dose dispenser further comprises a seal on the lid against which the compartment in registry with the dispensing opening is sealed.

30. The household appliance of claim 20, and further comprising a seal between the dispensing opening and the compartment in registry with the dispensing opening.

31. The household appliance of claim 30, wherein the bulk unit-dose dispenser further comprises a dispenser drive mechanism coupled with the track that sequentially advances the compartments into registry with the dispensing opening and engages the compartments with the seal.

32. The household appliance of claim 20, wherein the track comprises a conveyor belt carrying the plurality of compartments.

33. The household appliance of claim 32, wherein the track further comprises at least two pulleys about which the conveyor belt rotates.

34. The household appliance of claim 20, wherein the bulk unit-dose dispenser is configured to dispense multiple predetermined types of unit-doses.

35. The household appliance of claim 20 and further comprising a door assembly selectively closing the treating chamber, wherein the bulk unit-dose dispenser is carried by the door assembly.

36. The household appliance of claim 20, wherein the emitted liquid from the liquid sprayer defines a spray path, with at least part of the spray path at least temporarily intersecting the dispensing opening.

37. The household appliance of claim 20, and further comprising a cooling system providing cooling air to the bulk unit-dose dispenser.

38. The household appliance of claim 37, wherein the cooling system comprises a cooling fan in fluid communication with ambient air.

* * * * *